US008453705B2

(12) United States Patent
Miller et al.

(10) Patent No.: US 8,453,705 B2
(45) Date of Patent: Jun. 4, 2013

(54) VERTICALLY MOVABLE DOOR WITH SAFETY BARRIER

(75) Inventors: Jason D. Miller, Iowa Falls, IA (US); Donald P. Grant, Dubuque, IA (US); Paul J. Maly, Mequon, WI (US); Joseph A. Manone, Mequon, WI (US); Daniel M. Anderson, Oak Creek, WI (US); Ronald W. Bennett, Leesburg, GA (US); Mark G. Petri, Mequon, WI (US); Ronald P. Snyder, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 38 days.

(21) Appl. No.: 12/883,881

(22) Filed: Sep. 16, 2010

(65) Prior Publication Data

US 2011/0000626 A1 Jan. 6, 2011

Related U.S. Application Data

(62) Division of application No. 11/012,424, filed on Dec. 14, 2004, now Pat. No. 7,832,451.

(51) Int. Cl.
*E05D 15/18* (2006.01)

(52) U.S. Cl.
USPC ..... 160/113; 160/201

(58) Field of Classification Search
USPC ..... 160/113, 201, 184, 185, 186, 187, 160/202, 205, 290.1
See application file for complete search history.

(56) References Cited

U.S. PATENT DOCUMENTS

| | | | | |
|---|---|---|---|---|
| 1,357,106 | A | 10/1920 | McLellan | |
| 1,652,186 | A | 12/1927 | Strauss | |
| 1,666,508 | A | 4/1928 | Sawyer | |
| 2,072,092 | A | 3/1937 | Blodgett | |
| 2,088,046 | A | 7/1937 | White | |
| 2,113,587 | A * | 4/1938 | Gorar | 160/190 |
| 2,118,942 | A * | 5/1938 | Prescott | 160/185 |
| 2,154,421 | A * | 4/1939 | Cunningham | 160/202 |
| 2,237,106 | A | 4/1941 | Minert | |

(Continued)

OTHER PUBLICATIONS

State Intellectual Property Office, P.R. China, "Second Office Action," English Translation, issued in connection with Chinese application serial No. 200580042845.6, issued Mar. 9, 2011, 6 pages.

(Continued)

*Primary Examiner* — David Purol
(74) *Attorney, Agent, or Firm* — Hanley, Flight & Zimmerman, LLC

(57) ABSTRACT

A vertically moving door of a truck loading dock includes a disconnectable horizontal joint that provides the door with a barrier position, wherein an upper section of the door can be separated from a lower section to create a ventilation area between the two. The ventilation area allows fresh outside air to enter the building, while the lower section remains at its lowermost position for safety and security. More specifically, the lower section serves as a barrier that helps prevent someone or something from accidentally falling through the doorway when a truck is not present at the dock. A lightweight, resilient strap can be attached to the lower section of the door to help protect that section from an otherwise damaging impact. A lattice of straps or a mesh can be installed across the ventilation area to help secure the building against theft.

20 Claims, 26 Drawing Sheets

U.S. PATENT DOCUMENTS

| | | | | | |
|---|---|---|---|---|---|
| 2,295,205 | A | | 9/1942 | Fraser | |
| 2,378,004 | A | | 6/1945 | Duell | |
| 2,689,004 | A | | 9/1954 | Van Der Horst | |
| 3,021,896 | A | | 2/1962 | Buono et al. | |
| 3,103,967 | A | * | 9/1963 | Gaschen | 160/113 |
| 3,292,685 | A | | 12/1966 | Clark | |
| 3,841,661 | A | * | 10/1974 | Ehrlich | 410/156 |
| 4,356,668 | A | | 11/1982 | Wagner | |
| 4,378,043 | A | | 3/1983 | Sorenson | |
| 4,429,729 | A | | 2/1984 | Winslow | |
| 4,524,814 | A | * | 6/1985 | Deziel | 160/133 |
| 4,532,973 | A | * | 8/1985 | DeFalco | 160/235 |
| 4,653,566 | A | | 3/1987 | Miale | |
| 4,738,296 | A | * | 4/1988 | Hatch | 160/133 |
| 4,920,598 | A | | 5/1990 | Hahn | |
| 4,924,932 | A | * | 5/1990 | Esnault | 160/201 |
| 5,005,827 | A | | 4/1991 | Steinbrecher | |
| 5,029,819 | A | | 7/1991 | Kane | |
| 5,040,258 | A | | 8/1991 | Hahn et al. | |
| 5,046,544 | A | | 9/1991 | Coluccio | |
| 5,050,846 | A | | 9/1991 | Goodman et al. | |
| 5,118,056 | A | | 6/1992 | Jeanise | |
| 5,170,829 | A | | 12/1992 | Duncan et al. | |
| 5,408,789 | A | | 4/1995 | Plfeger | |
| 5,459,963 | A | | 10/1995 | Alexander | |
| 5,503,211 | A | * | 4/1996 | Engi | 160/290.1 |
| 5,505,244 | A | | 4/1996 | Thumann | |
| 5,564,238 | A | | 10/1996 | Ellis | |
| 5,584,333 | A | | 12/1996 | Torchetti et al. | |
| 5,611,382 | A | | 3/1997 | Sferra | |
| 5,624,203 | A | | 4/1997 | Jackson et al. | |
| 5,636,679 | A | | 6/1997 | Miller et al. | |
| 5,649,396 | A | | 7/1997 | Carr | |
| 5,660,144 | A | | 8/1997 | Venti | |
| 5,727,614 | A | | 3/1998 | Lichy | |
| 5,823,705 | A | | 10/1998 | Jackson et al. | |
| 5,846,127 | A | * | 12/1998 | Kile | 454/195 |
| 5,848,630 | A | | 12/1998 | Manzo | |
| 5,860,465 | A | | 1/1999 | Eastridge et al. | |
| 5,904,199 | A | | 5/1999 | Messner | |
| 5,927,368 | A | | 7/1999 | Rohrer et al. | |
| 6,041,846 | A | * | 3/2000 | Langlois | 160/201 |
| 6,092,580 | A | | 7/2000 | Lucas | |
| 6,186,274 | B1 | | 2/2001 | Reynolds et al. | |
| 6,260,601 | B1 | * | 7/2001 | Thomas | 160/133 |
| 6,279,276 | B1 | | 8/2001 | Knoll | |
| 6,283,427 | B1 | | 9/2001 | Moller et al. | |
| 6,315,027 | B1 | * | 11/2001 | Lichy | 160/205 |
| 6,371,189 | B1 | * | 4/2002 | Azoulai | 160/133 |
| 6,375,164 | B1 | | 4/2002 | Siegler et al. | |
| 6,375,165 | B1 | | 4/2002 | Sherratt et al. | |
| 6,485,225 | B1 | | 11/2002 | Baker | |
| 6,536,502 | B2 | | 3/2003 | Britto et al. | |
| 6,557,614 | B1 | | 5/2003 | Lampers | |
| 6,575,435 | B1 | | 6/2003 | Kotzen | |
| 6,595,496 | B1 | | 7/2003 | Langlie | |
| 6,615,898 | B2 | | 9/2003 | Schulte | |
| 6,655,442 | B2 | * | 12/2003 | Snyder | 160/201 |
| 6,688,480 | B1 | | 2/2004 | Denny | |
| 6,733,204 | B1 | | 5/2004 | Paniccia | |
| 6,776,398 | B1 | | 8/2004 | Tsai | |
| 6,807,999 | B1 | | 10/2004 | Bowen et al. | |
| 7,509,990 | B1 | * | 3/2009 | Milligan | 160/113 |
| 7,726,378 | B1 | * | 6/2010 | Savon | 160/201 |
| 7,775,252 | B2 | | 8/2010 | Snyder et al. | |
| 2003/0016996 | A1 | | 1/2003 | Gelfand et al. | |
| 2003/0079845 | A1 | | 5/2003 | Stern, Jr. | |
| 2005/0072074 | A1 | * | 4/2005 | Moore | 52/204.5 |
| 2006/0124252 | A1 | | 6/2006 | Miller et al. | |

OTHER PUBLICATIONS

United States Patent and Trademark Office, "Notice of Allowance," issued in connection with U.S. Appl. No. 11/012,424, mailed Jul. 13, 2010, 11 pages.

United States Patent and Trademark Office, "Final Office Action," issued in connection with U.S. Appl. No. 11/012,424, mailed Jun. 10, 2010, 9 pages.

United States Patent and Trademark Office, "Non-Final Office Action," issued in connection with U.S. Appl. No. 11/012,424, mailed Nov. 25, 2009, 5 pages.

United States Patent and Trademark Office, "Final Office Action," issued in connection with U.S. Appl. No. 11/012,424, mailed Jul. 22, 2009, 13 pages.

United States Patent and Trademark Office, "Non-Final Office Action," issued in connection with U.S. Appl. No. 11/012,424, mailed Jun. 2, 2008, 18 pages.

United States Patent and Trademark Office, "Restriction Requirement," issued in connection with U.S. Appl. No. 11/012,424, mailed Feb. 25, 2008, 5 pages.

International Searching Authority, "International Search Report," issued in connection with international application serial No. PCT/US05/45279, mailed Jun. 17, 2008, 2 pages.

International Searching Authority, "Written Opinion of the International Searching Authority," issued in connection with international application serial No. PCT/US05/45279, mailed Jun. 17, 2008, 4 pages.

International Bureau, "International Preliminary Report on Patentability," issued in connection with international application serial No. PCT/US05/45279, mailed Mar. 12, 2009, 5 pages.

State Intellectual Property Office, P.R. China, "First Office Action," with English translation, issued in connection with Chinese application serial No. 200580042845.6, issued Mar. 18, 2010, 13 pages.

United States Patent and Trademark Office, "Supplemental Notice of Allowance," issued in connection with U.S. Appl. No. 11/339,152, mailed May 18, 2010, 4 pages.

United States Patent and Trademark Office, "Notice of Allowance," issued in connection with U.S. Appl. No. 11/339,152, mailed Oct. 6, 2009, 21 pages.

United States Patent and Trademark Office, "Non-Final Office Action," issued in connection with U.S. Appl. No. 11/339,152, mailed Jan. 5, 2009, 21 pages.

Gaylord Material Handling, Inc., "Dock Strap," web page advertising DockStrap™ product, dated May 14, 2002, 1 page.

Engination LLC, "Rite-Hite Aftermarket Meeting," Engination Product Brochure, dated Jul. 9, 2003, 8 pages.

United States Patent and Trademark Office, Notice of Allowance, issued in connection with U.S. Appl. No. 11/339,152, mailed Apr. 7, 2010, 12 pages.

United States Patent and Trademark Office, "Supplemental Notice of Allowance," issued in connection with U.S. Appl. No. 11/339,152, mailed Dec. 24, 2009, 7 pages.

United States Patent and Trademark Office, "Non-Final Office Action," issued in connection with U.S. Appl. No. 11/339,152, mailed Oct. 1, 2008, 7 pages.

United States Patent and Trademark Office, "Interview Summary," issued in connection with U.S. Appl. No. 11/339,152, mailed Jan. 20, 2010, 3 pages.

United States Patent and Trademark Office, "Restriction Requirement," issued in connection with U.S. Appl. No. 11/339,152, mailed Oct. 1, 2008, 7 pages.

Chinese Patent Office, "Decision on Rejection," issued in connection with Chinese Patent Application No. 200580042845.6, mailed on Feb. 28, 2012, 6 pages.

* cited by examiner

VERTICALLY MOVABLE DOOR WITH SAFETY BARRIER

RELATED APPLICATION

This patent arises from a divisional of U.S. patent application Ser. No. 11/012,424, filed Dec. 14, 2004, which is hereby incorporated herein in its entirety.

BACKGROUND OF THE INVENTION

1. Field of the Invention

The subject invention generally pertains to vertically movable doors and more specifically to a door that is particularly suitable for use at a truck loading dock or other location where ventilation, safety or security may be important.

2. Description of Related Art

Many buildings may have a doorway with a loading dock to facilitate transferring cargo between a truck and the building. A loading dock is a platform that is generally at the same elevation as the bed of the truck or its trailer. The dock may also include a dock leveler, which is a vertically movable ramp that compensates for a height differential that may exist between the platform and the truck bed. Dock levelers may also provide a bridge across which personnel and material handling equipment can travel between the platform and the truck.

For protection against weather and theft, the doorway of the building may include a manual or power operated door. Doors for loading docks usually open and close by moving vertically so as not to interfere with the rear of the truck or interfere with cargo and activity just inside the doorway.

When there is no truck at the dock and the weather is mild, the door may be left open to help ventilate the building with fresh outside air. Leaving the door open, however, reduces the building's security and increases the risk of personnel or items inside the building from accidentally falling off the edge of the dock's platform and through the open doorway to the driveway. But even with the door closed, heavy material handling equipment, such a forklift truck, may have enough power or momentum to accidentally break through the door and still fall off the edge.

Barriers of various types are used in a loading dock environment to prevent the accidental run-off noted above. In fact, some loading dock levelers feature extended lips that can provide a run-off barrier when the leveler is in an inoperative position, but these barrier-style levelers do not protect the loading dock door from impact when the door is closed because the extended lip is outside of the door. Examples of barrier-style dock levelers can be seen in U.S. Pat. Nos. 4,920,598 and 5,040,258. Other barriers, such as a simple safety gate better protect the loading dock door, but they are typically manually activated or require a separate operational step to position the barrier. Examples of a gate-type barrier are the Rite-Hite Dok Guardian product and the inventions disclosed in U.S. Pat. Nos. 5,459,963 and 5,564,238.

A variety of other patents are directed to loading dock door systems. U.S. Pat. No. 5,408,789, for example, discloses a unique loading dock door system that automatically places a barrier to both prevent run-off and protect the door, itself, from impact. The patented system may not only include what appears to be a conventional vertically moving door, but also an additional screen door for ventilation and security. For run-off protection and to protect the screen door from impact, a safety barrier (which appears to be a rigid bar) is attached to the screen door. A system of this type, in which the barrier is automatically placed when the door is closed, provides the additional convenience of not requiring an operator to perform an additional operation (in the case of a manually positioned barrier) or an additional driving mechanism (in the case of an automatically positioned barrier) to position the barrier. Further, the system ensures that the barrier is always in place when the door is closed, thus ensuring protection of the door from impact damage. However, because the barrier travels with the door, it is also removed when the door is opened, leaving no run-off protection. Further, the system actually includes two doors with two sets of tracks, which is likely more expensive than a single door. The two doors also take up more floor space in a loading dock area where floor space is often limited. The rigid bar disclosed in this system would also be subject to permanent deformation when impacted by a fork truck or similar conveyance.

In another attempt to provide ventilation to a sectional door, the system disclosed in U.S. Pat. No. 6,092,580, includes a screened gate that can be selectively attached or removed from the lowermost panel of a garage door. Because the screened gate is not part of the garage door itself, it does not have its own rollers for traveling along the door's tracks. Instead, the gate is either attached to the frame of the doorway using Velcro strips (FIG. 6), or the gate stows against the inside face of the lowest door panel (FIG. 11). The screened gate can also be manually detached from the door and left on the ground (attached to the doorway frame with Velcro) to provide a barrier for pets and children. Although it may be an effective system for its intended purpose of providing a barrier to pets and children, while also providing them with ventilation, such a system would be unacceptable for use at a loading dock for several reasons.

First, an industrial barrier for impeding forklifts at a loading dock generally needs to be relatively strong, particularly at floor level where the forklifts travel. With the '580 system, however, the screen, which appears to be one of the weaker members of the door, is placed at the very bottom of the door to serve as a barrier, while the more solid door panels are higher up.

Second, vertically moving sectional doors (e.g., garage doors) typically have a spring-loaded system for counterbalancing the weight of the door panels, thereby making the door easier to operate. Adding or removing weight from the door by selectively attaching or disconnecting a panel can change the weight equilibrium of the door. Depending on whether weight is added or removed, the door may have a strong bias to open or close. This may not be a problem for the '580 system, because the screened gate appears to be relatively lightweight, but a much heavier panel is needed to stop a forklift. Adding or removing the weight of a heavy, truck-stopping panel from an industrial door may cause the door to fling open or close abruptly.

SUMMARY OF THE INVENTION

In some embodiments, a vertically moving door includes a separable horizontal joint that enables the door to selectively move to a closed position, a barrier position and an open position.

In some embodiments, the separable horizontal joint, when intact, provides a pivotal connection between an upper and lower section of the door.

In some embodiments, the separable horizontal joint creates a ventilation area between the upper and lower sections of the door, and for security or for providing a barrier to insects, a screen or a lattice of straps extends across the ventilation area.

In some embodiments, a counterbalance, such as a spring or deadweight, helps compensate for the weight change caused by separating or reconnecting the lower section of the door to the upper section.

In some embodiments, a winch, hoist or chainfall helps separate and/or reconnect the upper and lower door sections in a controlled manner.

In some embodiments, a mechanically actuated latch at the horizontal joint helps hold the upper and lower sections of the door together.

In some embodiments, an electrically actuated latch at the horizontal joint helps hold the upper and lower sections of the door together.

In some embodiments, a latch helps hold the lower section of the door down when the upper section is raised for ventilation.

In some embodiments, a resilient, shock-absorbing barrier is attached to a vertically moving door.

In some embodiments, a strap held in tension serves as the resilient, shock-absorbing barrier.

In some embodiments, an existing conventional door is modified as a horizontally split door.

In some embodiments, an existing conventional door is modified to include a resilient, shock-absorbing barrier.

DESCRIPTION OF THE PREFERRED EMBODIMENT

Figure 1:
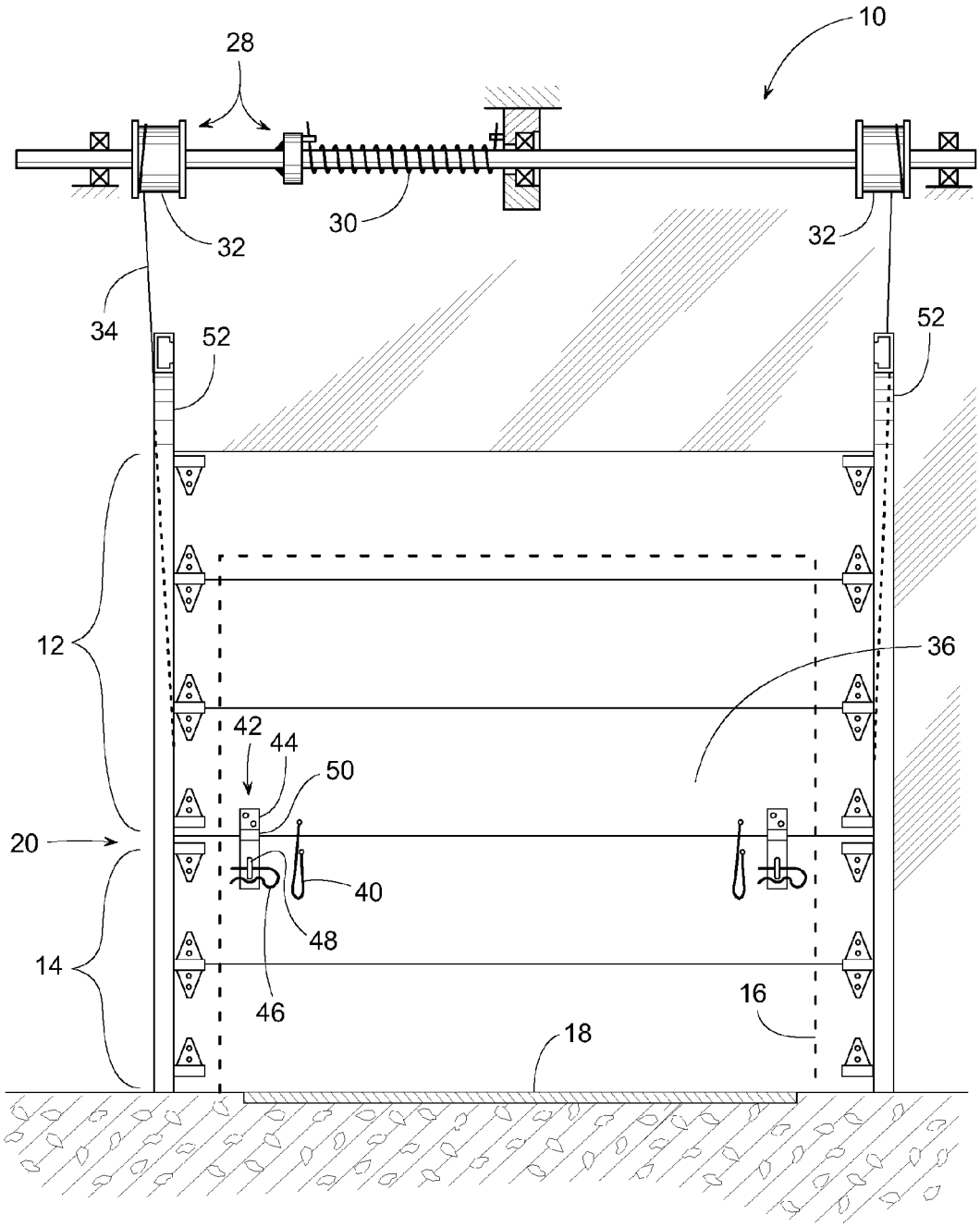
FIG. 1 is a front view of a closed door as viewed from inside the building.
Figure 2:
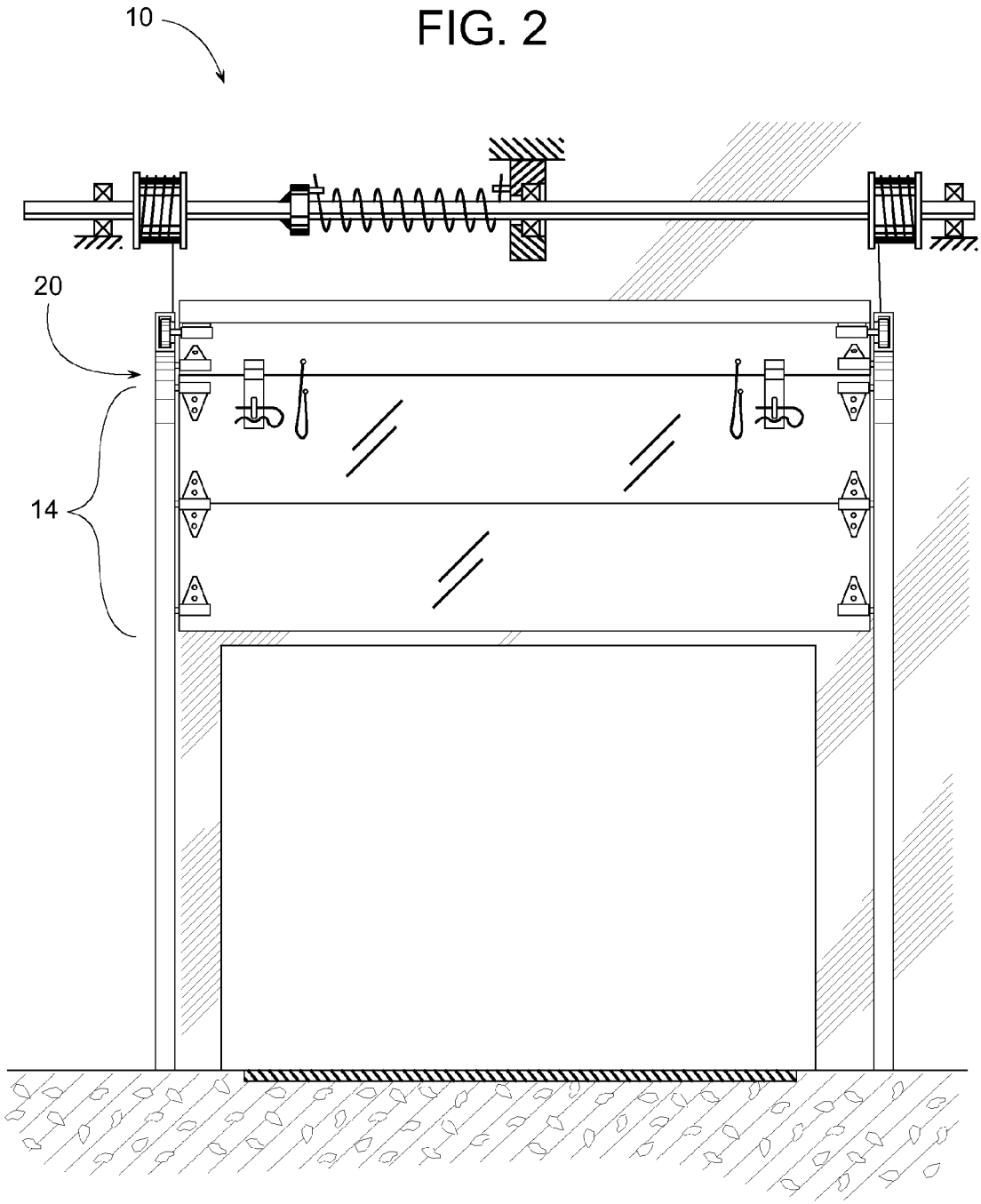
FIG. 2 is a front view similar to FIG. 1 but showing the door at its open, position.
Figure 3:
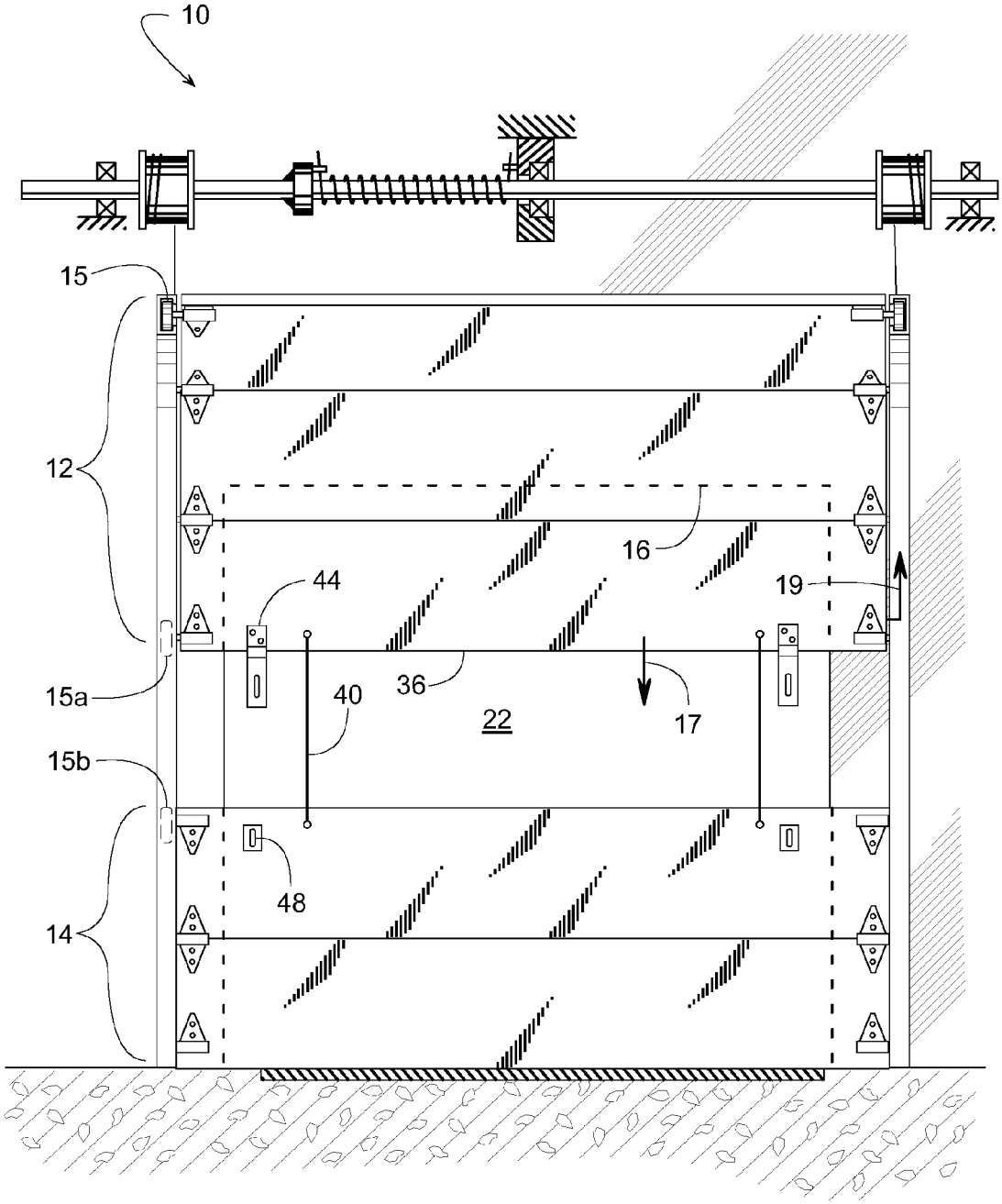
FIG. 3 is a front view similar to FIGS. 1 and 2, but showing the door at its barrier position and creating a ventilation area between an upper and lower section of the door.

FIGS. 1-3 show a door 10 with an upper section 12 and a lower section 14 that are vertically movable to selectively open up and close off a doorway 16. Doorway 16 is for a loading dock, which in this example happens to have a dock leveler 18 (see also FIGS. 6 and 7). The drawing figures show the door as it would appear from inside the building looking out. FIG. 1 shows door 10 at its closed position, and FIG. 2 shows door 10 at its open position.

To provide security and safety when lower section 14 is at its fully lowered position and no truck is present while simultaneously allowing the benefit of fresh air ventilation, door 10 can be moved to a barrier position, as shown in FIG. 3. The barrier position is made possible by a disconnectable joint 20 that enables upper section 12 to separate and lift away from lower section 14, thereby creating a ventilation area 22 between the two. The structural details of disconnectable joint 20 will be explained later. With door 10 at its barrier position, area 22 permits outside air to pass through the doorway.

Moreover, with lower section 14 at its fully lowered position, section 14 serves as a barrier that helps prevent material handling equipment, personnel or items on the dock platform from accidentally falling through the doorway and onto the driveway and further provides a level of security that helps prevent intruders from entering the building. Lower section 14 can serve as a barrier in itself without the need for additional impact-absorbing structure because lower section 14 is part of the door that is already engaged within a set of tracks 52. Moreover, lower section 14 is preferably tougher and more resilient than upper section 12 so that lower section 14 can provide an effective impact-resistant barrier (as seen in U.S. Pat. No. 6,655,442).

Accordingly, closing of the door 10 automatically places a barrier (lower panel 14) in a position to prevent runoff of personnel or equipment. The door can then be partially opened while leaving the barrier in place by separating the disconnectable joint 20 and raising the upper section(s) 12. The benefit of automatically placing a run-off barrier, leaving the barrier in place, and at least partially opening the door, is thus obtained.

Figure 4:
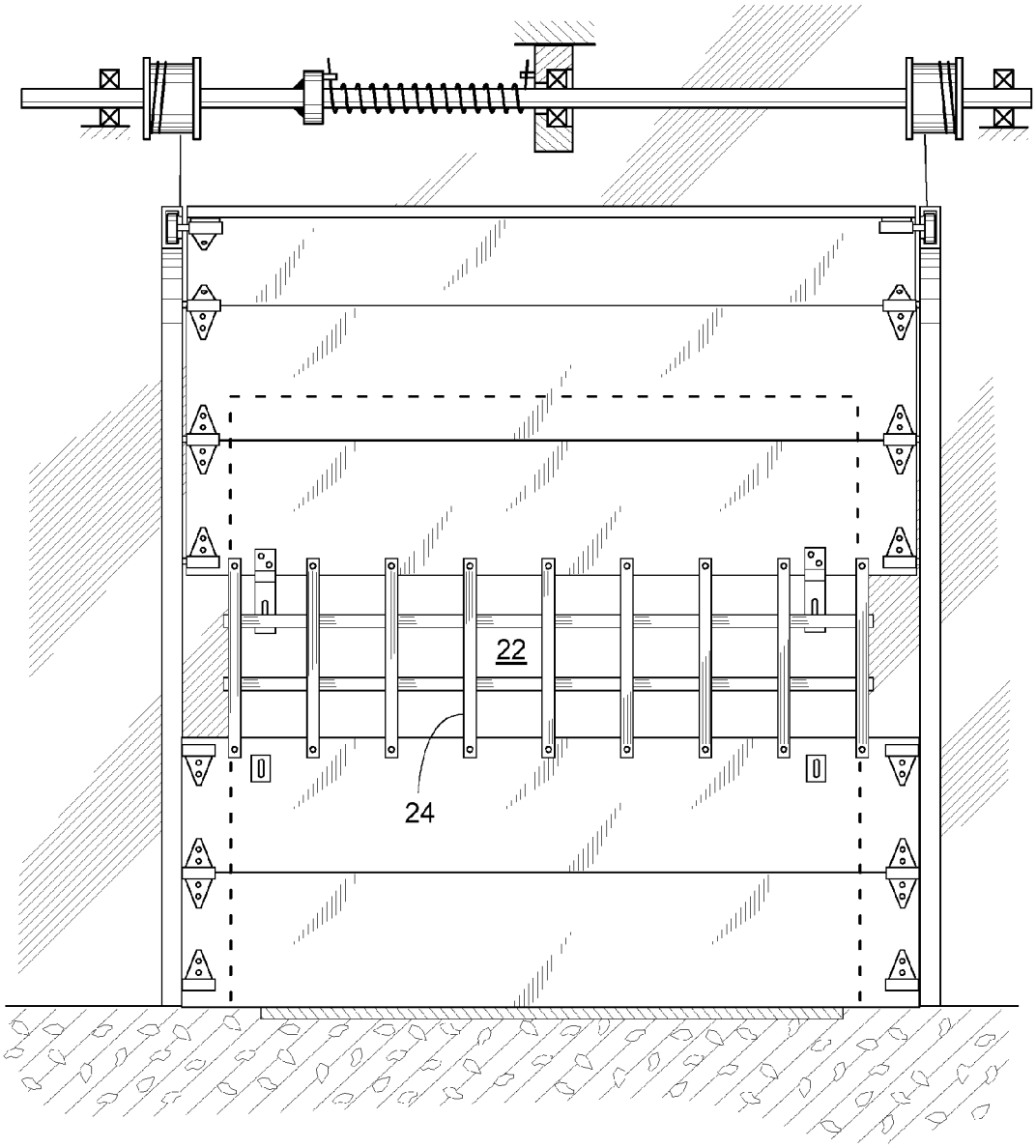
FIG. 4 is a front view showing a plurality of straps extending across the ventilation area of the door.
Figure 5:
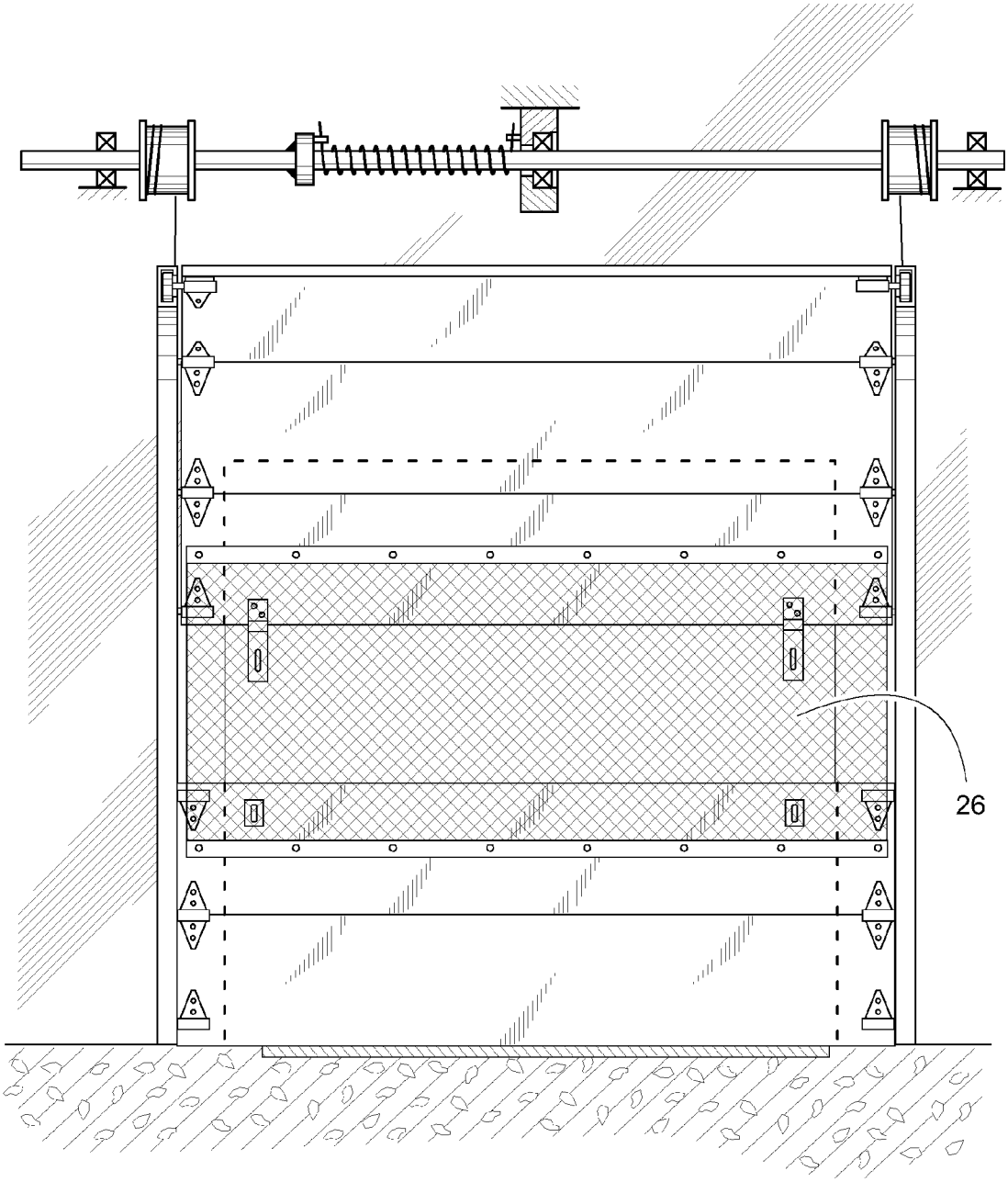
FIG. 5 is a front view showing a screen mesh extending across the ventilation area of the door.

For greater security or to prevent insects from passing through ventilation area 22, a lattice of pliable straps 24 (FIG. 4) or a screen 26 (FIG. 5) can be attached to upper and lower sections 12 and 14 to cover area 22. In some embodiments, however, straps 24 or screen 26 could be replaced by a cable, chain, belting, fabric, etc. or just simply eliminated altogether without replacing it with anything else.

Figure 6:
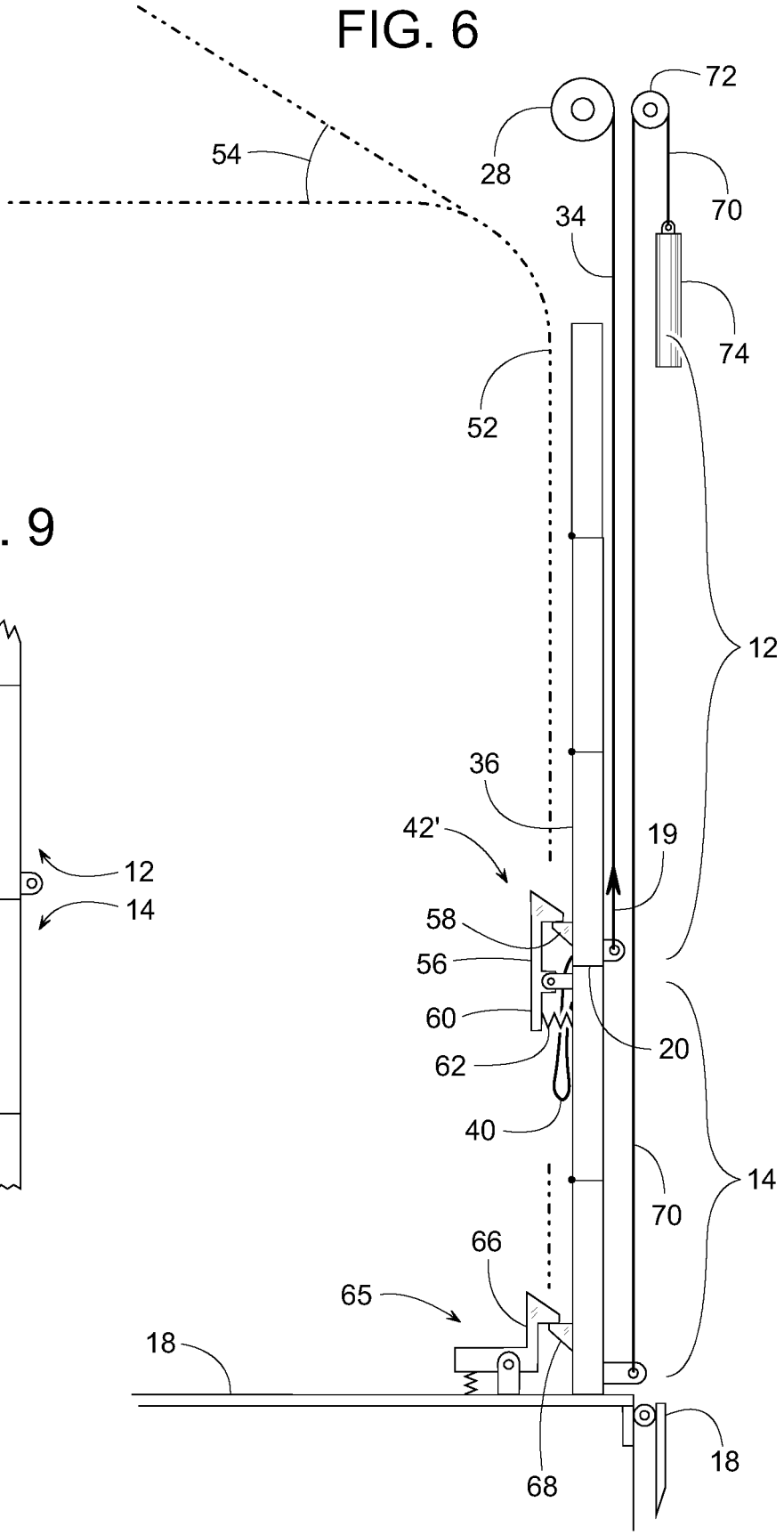
FIG. 6 is a schematic side view of a door at its closed position.
Figure 7:
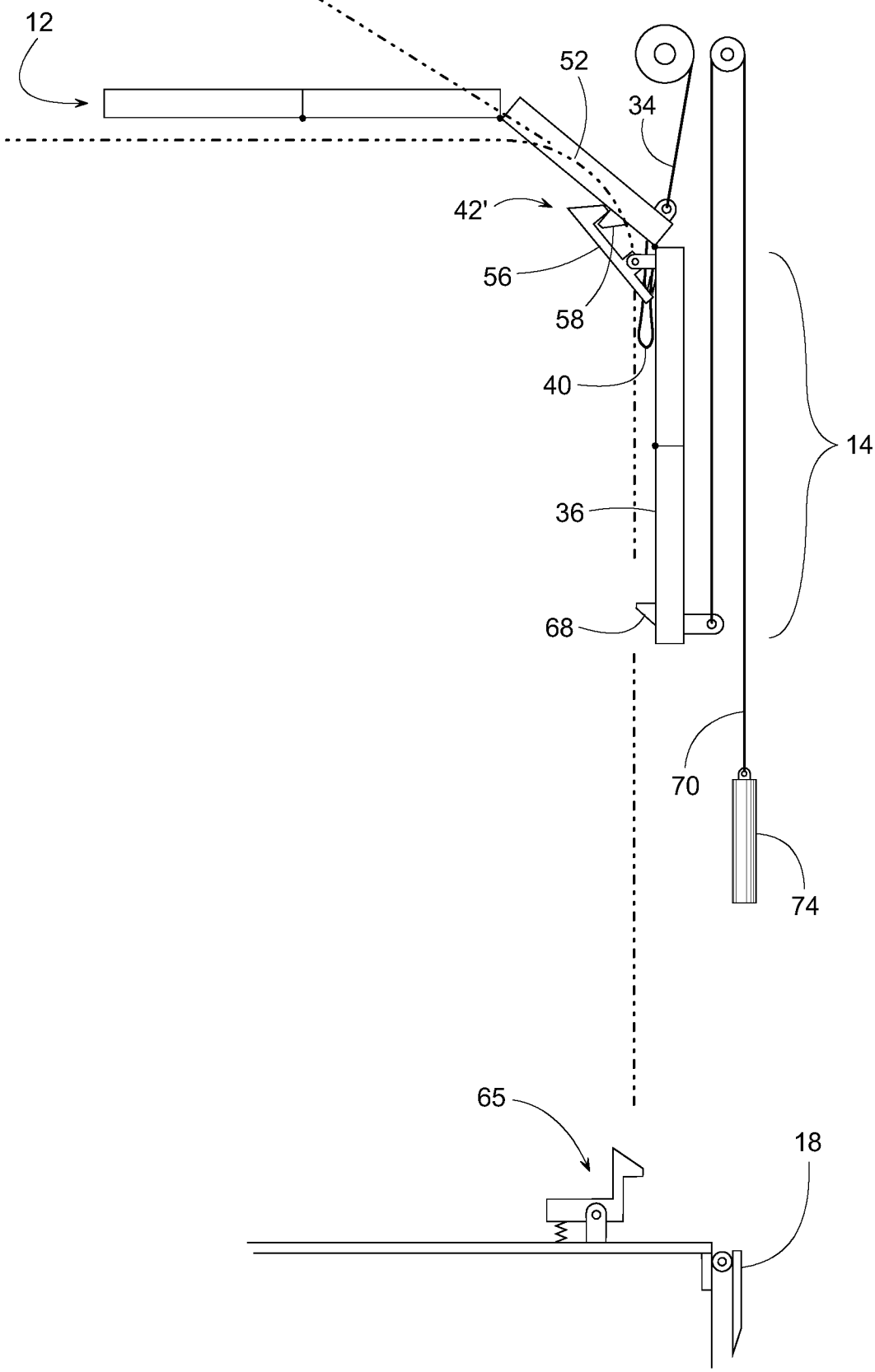
FIG. 7 is a schematic side view similar to FIG. 6 but showing the door at its open position.
Figure 8:
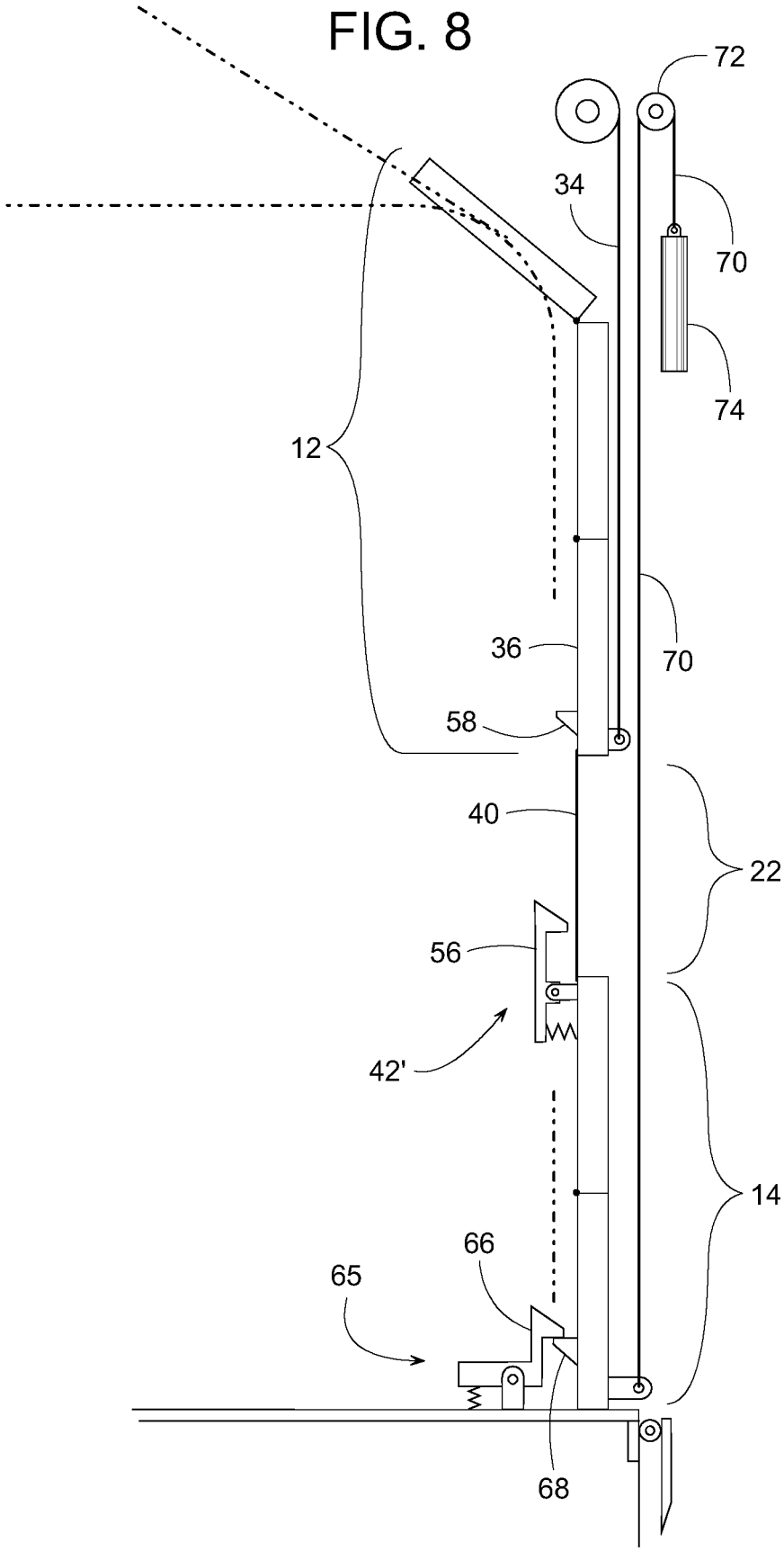
FIG. 8 is a schematic side view similar to FIGS. 6 and 7 but showing the door at its barrier position.

Straps 24 and screen 26 may also serve as a separation-limiting member. Door 10, for example, may have a counterbalance 28 for offsetting the combined weight of the upper and lower sections 12 and 14, whereby counterbalance 28 reduces the lifting force needed to open the door. Counterbalance 28 could be a counterweight or a torsion spring 30 acting upon one or more take-up drums 32, wherein a cable 34 (elongate member) on the drums connects to a lowermost panel 36 of upper section 12 (FIGS. 6-8). The tension in cable 34 exerts an upward force 19 against upper section 12. When upper section 12 rises from the closed position of FIG. 1 to the barrier position of FIG. 3, the full power of counterbalance 28 only carries the weight of upper section 12, which of course is lighter than the combined weight of sections 12 and 14. Consequently, counterbalance 28 may overpower the lifting of upper section 12 and tend to lift upper section 12 all the way up or lift it in an uncontrolled manner. To prevent this from happening, straps 24 or screen 26 may serve to compensate for the door weight differential that exists between the separated and unseparated conditions of the door by providing a restraint or separation-limiting member that can limit the distance that upper section 12 can lift away from lower section 14. When door 10 is at its barrier position of FIG. 3, the tension in the separation-limiting member exerts a downward force 17 against upper section 12.

Referring back to FIGS. 1-3, if security and insects are not a concern, the function of compensating for the separated/unseparated weight differential of the door can be performed by a separation-limiting member between sections 12 and 14 in the form of a simple elongate member 40, such as a cable or chain, instead of screen 26 or straps 24. If a drive unit powers the door open, it is conceivable that elongate member 40, screen 26 and straps 24 could all be omitted, and the drive unit itself could limit the distance that upper section 12 lifts away from lower section 14 thus compensating for the weight difference caused by releasing the lower section 14.

Another method of compensating for the weight differential caused by separation of the door, and for preventing counterbalance 28 from overpowering the lifting of upper section 12 when the weight of lower section 14 is removed, is to include a deadweight (not shown) that can be automatically or manually added to upper section 12 when the lower section is not being lifted and automatically or manually removed when the upper and lower sections are lifted together. Alternatively, a cable 70 (second elongate member) connected to lower section 14 and supported by a roller 72 can suspend a deadweight 74 to offset the weight of lower section 14 (i.e., deadweight 74 and lower section 14 weigh approximately the same). In this way, connecting or disconnecting lower section 14 from upper section 12 makes a negligible difference to the overall weight that counterbalance 28 needs to offset. Thus, counterbalance 28 can be adjusted to carry just the weight of upper section 12 alone.

Figure 10:
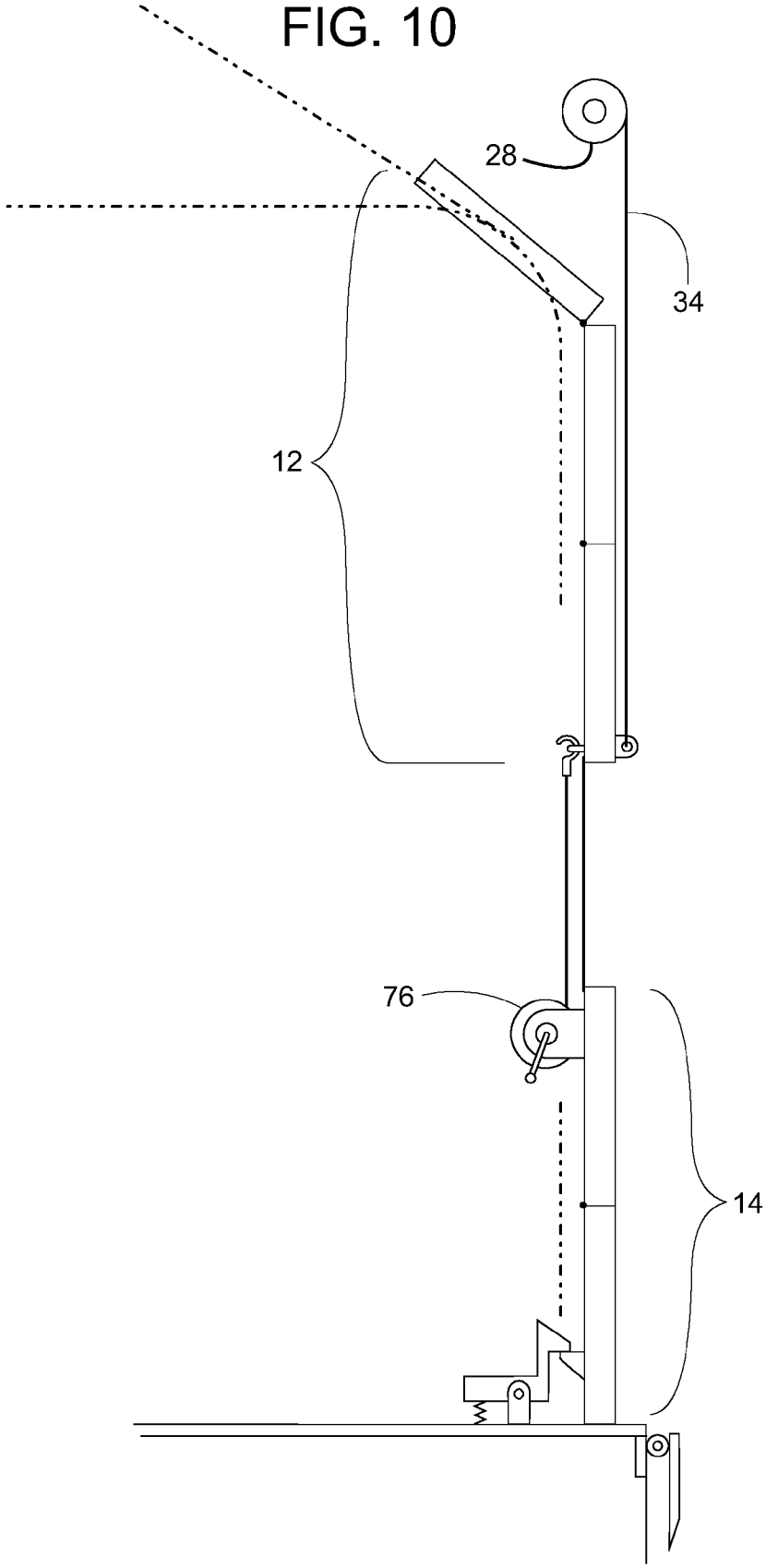
FIG. 10 is a schematic side view similar to FIG. 9 but with a winch installed to assist in moving the door's upper and lower sections together or apart.

Installing a winch 76 between sections 12 and 14, as shown in FIG. 10, is another option for compensating for the weight differential created by adding or removing the weight of lower section 14. When counterbalance 28 is adjusted to offset the full combined weight of sections 12 and 14, winch 76 allows counterbalance 28 to lift upper section 12 away from lower section 14 in a more controlled manner. More specifically, counterbalance 28 can lift upper section 12 no faster than what winch 76 allows because the friction and internal spring of winch 76 provide a downward force that mimics the weight of section 14.

Figure 11:
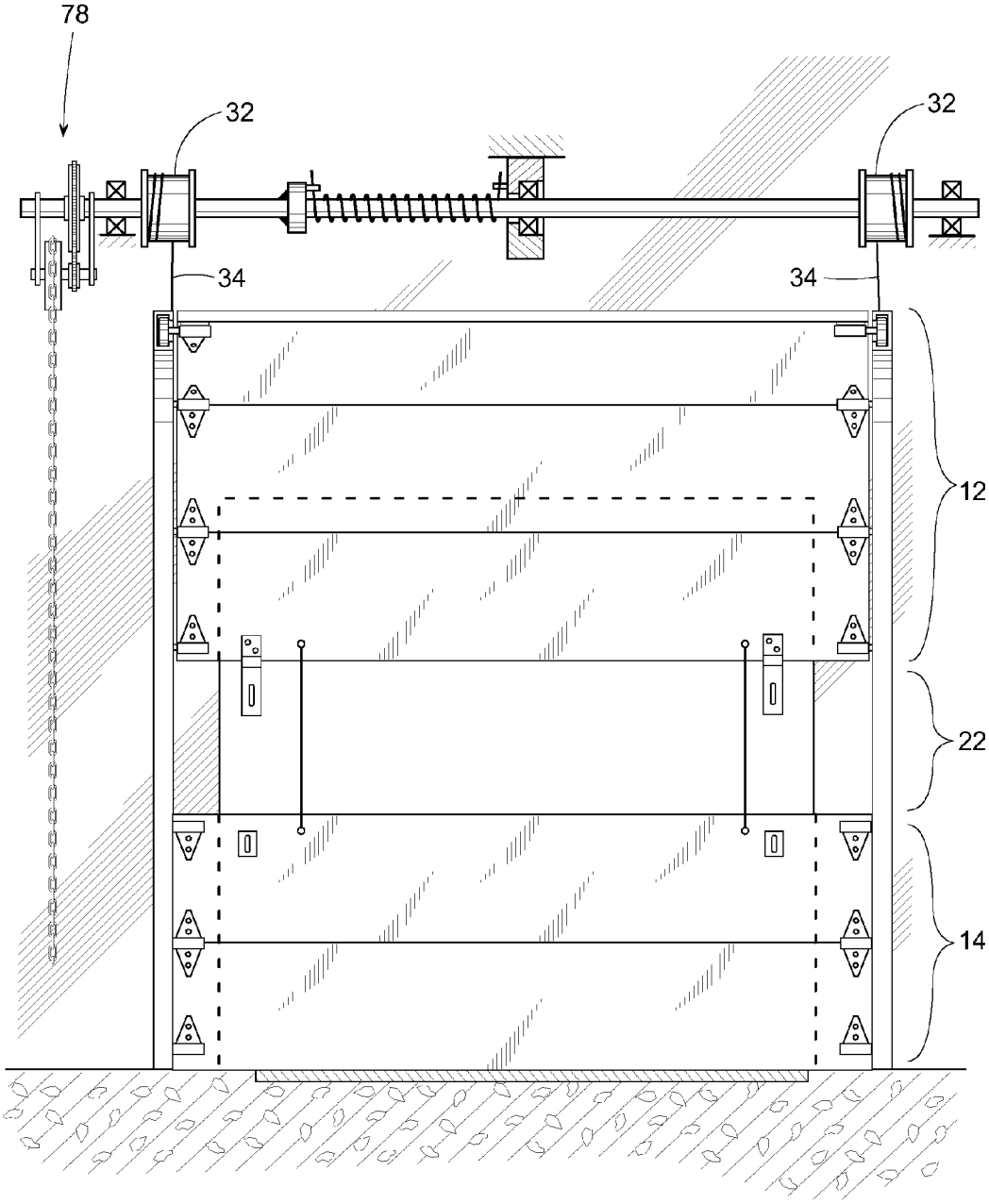
FIG. 11 is a front view similar to FIG. 3 but with a hoist installed to assist in moving the door's upper and lower sections together or apart.

Referring to FIG. 11, yet another alternative for controllably separating and reconnecting sections 12 and 14 is to install a hoist 78, such a conventional manually operated chainfall, that helps control the rotational speed and direction of counterbalance drums 32, which in turn carry the cables 34 that connect to upper section 12. Hoist 78 can rotate drums 32 to raise or lower upper section 12 at a controlled rate, regardless of whether upper section 12 is carrying the weight of lower section 14.

Figure 12:
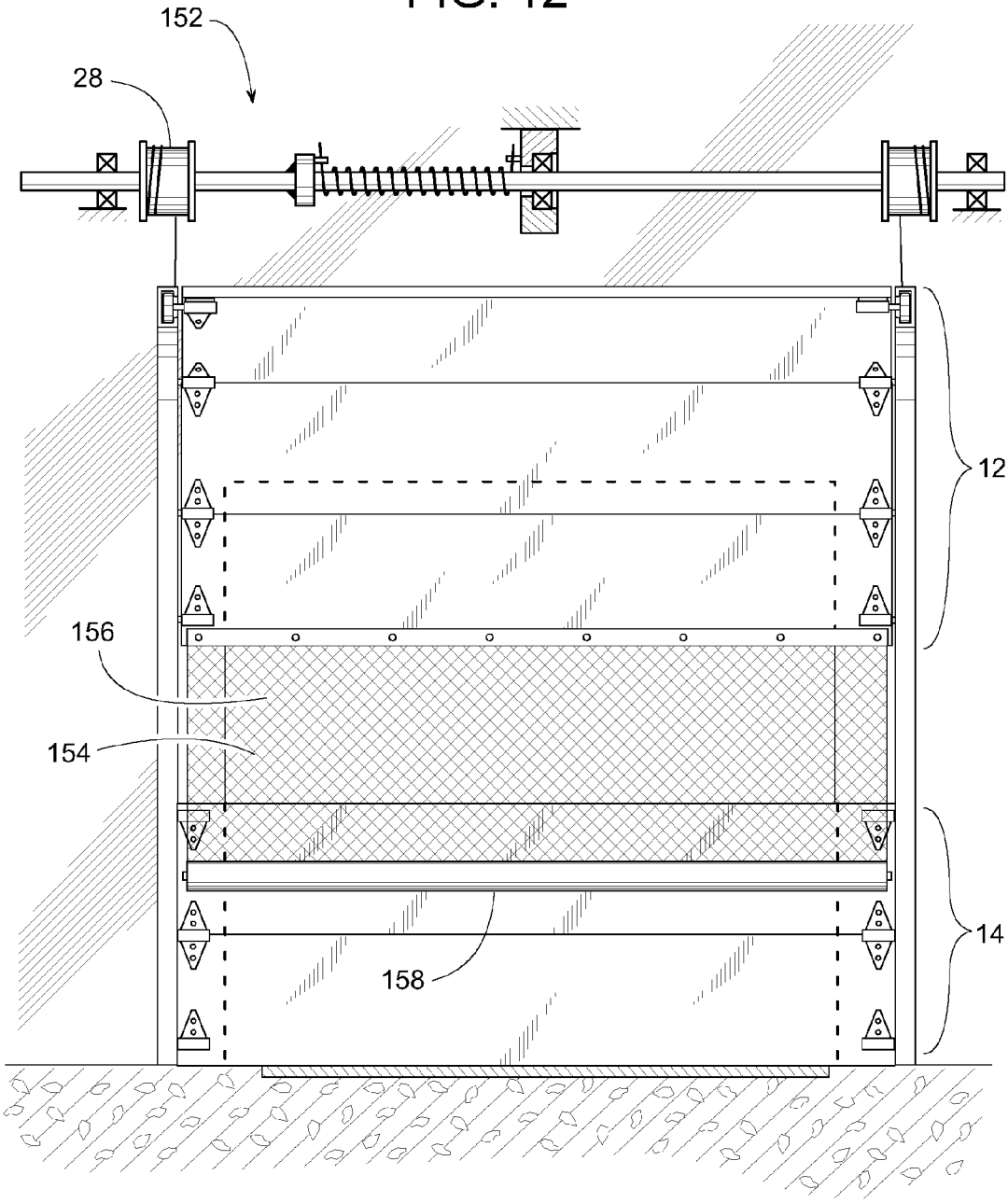
FIG. 12 is a front view of another door embodiment at its barrier position.
Figure 13:
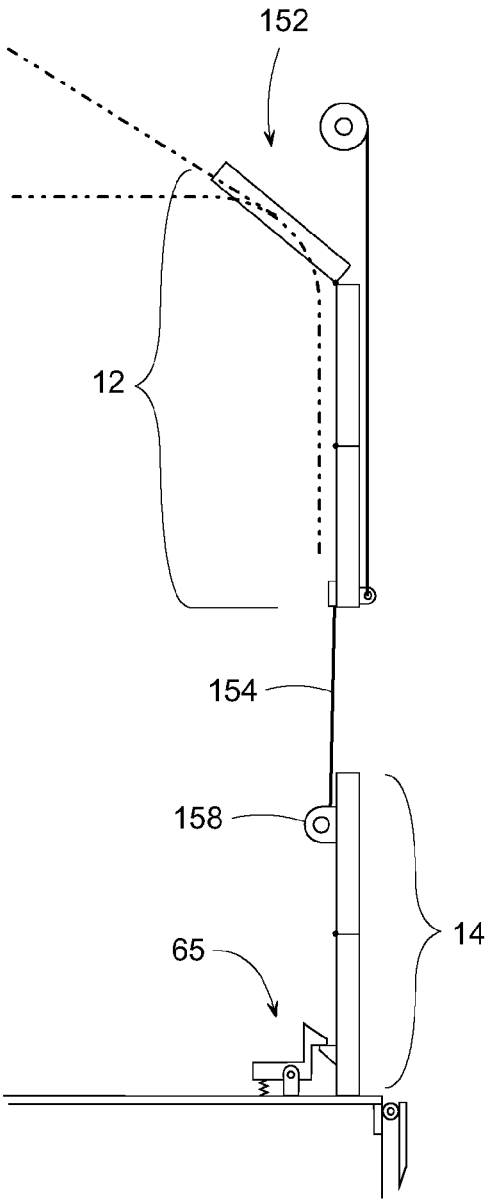
FIG. 13 is a schematic end view of the door of FIG. 12.
Figure 14:
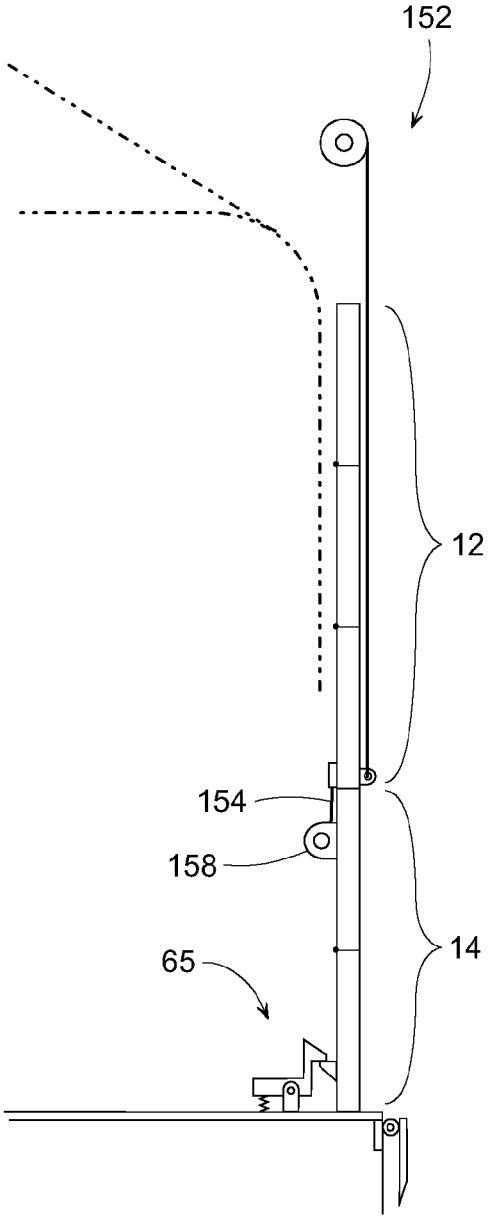
FIG. 14 is a schematic end view similar to FIG. 13 but showing the door in a closed position.

In another embodiment demonstrating weight compensation, shown in FIGS. 12-14, upper section 12 and lower section 14 of a door 152 are coupled by a separation-limiting member 154, wherein member 154 comprises a mesh 156 (or straps, cables, etc.) wrapped around a spring-loaded roll tube 158. A torsion spring in roll tube 158 maintains mesh 156 in tension. The tension pulls downward on upper section 12 with a force comparable to the weight of lower section 14. This helps maintain a more constant load on counterbalance 28 regardless of whether sections 12 and 14 are engaged (FIG. 14) or disengaged (FIGS. 12 and 13). If roll tube 158 creates a tension in mesh 156 that is greater than the weight of lower section 14, then holding device 65 (FIGS. 13 and 14) can be added, and a latch assembly, such as latch 42, is unnecessary.

Figure 15:
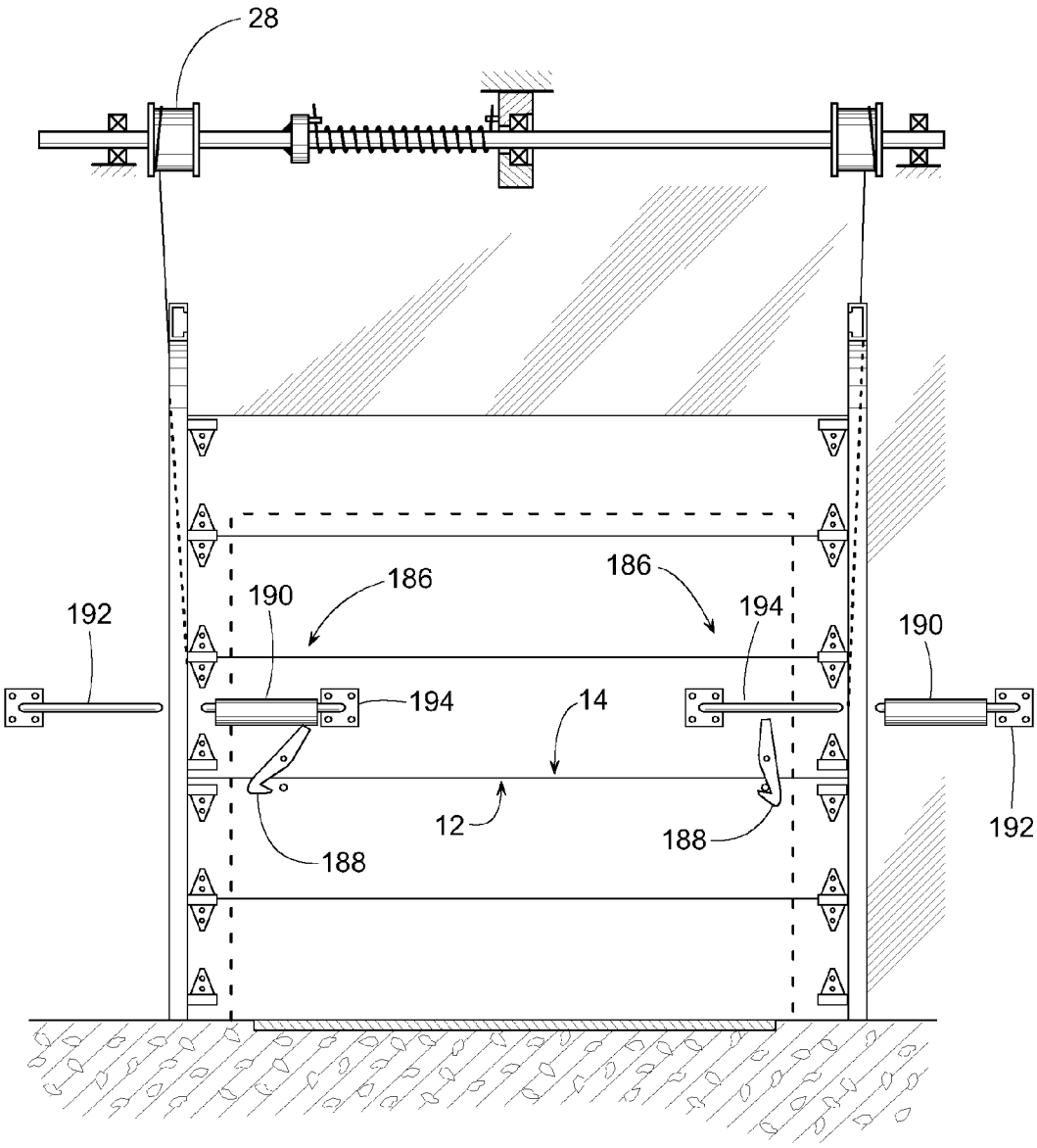
FIG. 15 is a front view of a door with weight transfer system working in conjunction with a latch mechanism.

In another embodiment with structure performing the weight compensation function, shown in FIG. 15, a door 184 includes a weight transfer system 186 that works in conjunction with a latch 188 that separates the upper and lower door sections. System 186 includes a deadweight 190 (e.g., a metal pipe) that can be manually slid between a wall-mounted rack 192 and a door-mounted rack 194. When latch 188 is latched and deadweight 190 is stored on the wall-mounted rack 192, as shown in the right side of the drawing figure, upper and lower door sections 12 and 14 are engaged to open and close as a unit. Counterbalance 28 is set to match the combined weight of door sections 12 and 14, so the door can open and close smoothly and controllably.

To separate sections 12 and 14, deadweight 190 can be slid from wall-mounted rack 192 to door-mounted rack 194, as shown in the left side of FIG. 15. Moving deadweight 190 onto door-mounted rack 194 not only unlatches latch 188, but also beneficially adds weight to the door's upper section 12, whereby the added weight of deadweight 190 compensates for unlatching or releasing the weight of the door's lower section 14 from counterbalance 28. With the combined weight of door sections 12 and 14 being substantially equal to the combined weight of upper section 12 and deadweight 190, the load on counterbalance 28 remains generally constant regardless of whether sections 12 and 14 are engaged or separated.

At certain times (e.g., during bad weather) it may be desirable for the ventilation area to be closed and for the door to be used as a typical sectional door. To close ventilation area 22, sections 12 and 14 are brought together, and a latch or latch assembly 42 keeps them engaged as the door opens and closes. For the embodiment of FIGS. 1-3, latch 42 is a conventional hasp 44 with a removable hairpin 46 that fits through a padlock ring 48. When hasp 44 extends to engage its padlock ring 48, the hasp's hinge pin 50 provides a pivotal connection between sections 12 and 14. The pivotal connection enables sections 12 and 14, which may comprise a plurality of pivotally interconnected door panels, to follow a curved track 52, such as those typically used for vertically moving doors that stow their door panels along a generally horizontal overhead plane.

In some embodiments, track followers 15 (e.g., rollers, tabs, etc.) travel within track 52 to help guide the movement of door 10. Upper track followers 15*a* extending from door section 12 and a lower track followers 15*b* extending from lower door section 14 help guide the translation of sections 12 and 14 respectively For the right side of the door, the upper and lower track followers share the same track, and the same is true for the left side of the door.

It should be noted, however, that the present invention is not limited to vertically moving doors with pivotally interconnected panels that stow horizontally overhead. In the open position, the upper and lower door sections may lie in a generally vertical plane or at some angle between horizontal and vertical, as indicated by angle 54 of FIG. 6. Sections 12 and 14 may each comprise a plurality of interconnected panels, or each may be a single panel. A metal roll-up door whose vertically moving door panel comprises a plurality of pivotally interconnected metal segments is also well within the scope of the invention. The subject invention applies to powered doors, manually operated doors, doors with a counterbalance, and doors without a counterbalance. Additional modifications will now be explained with reference to the schematic drawings of FIGS. 6, 7 and 8, which correspond to FIGS. 1, 2 and 3, respectively.

Figure 9:
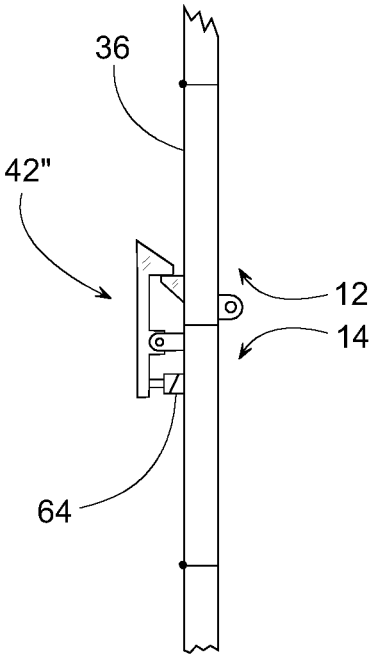
FIG. 9 is a schematic side view similar to FIG. 6 but with portions cutaway and with an electrically rather than a mechanically actuated latch.

In some embodiments, a latch 42' may engage automatically upon the upper and lower sections 12 and 14 coming together. Latch 42', for example, may comprise a spring-loaded pivotal arm 56 that selectively engages a catch member 58. Arm 56 can be attached to lower section 14, and catch member 58 can be attached to upper section 12, or the mounting positions of arm 56 and member 58 can be reversed. Arm 56 and/or catch member 58 has a tapered cam surface that when the arm 56 and catch member 58 come together, the cam surface pushes arm 56 away so that the arm can reach out and over catch member 58 to automatically latch onto member 58. Latch 42' can be disengaged by manually pushing a lower end 60 of arm 56 against the urging of a compression spring 62, or a similar latch 42" can be electrically engaged and/or disengaged by way of an electromechanical actuator, such as a solenoid 64, as shown in FIG. 9. Controlling solenoid 64 can be accomplished through a conventional hardwired control panel or via a wireless transmitter/receiver set.

FIG. 7 shows the flexibility of latch 42' as upper section 12 travels around curved track 52. FIG. 8 shows door 10 in its barrier position where latch 42' is disengaged.

Figure 16:
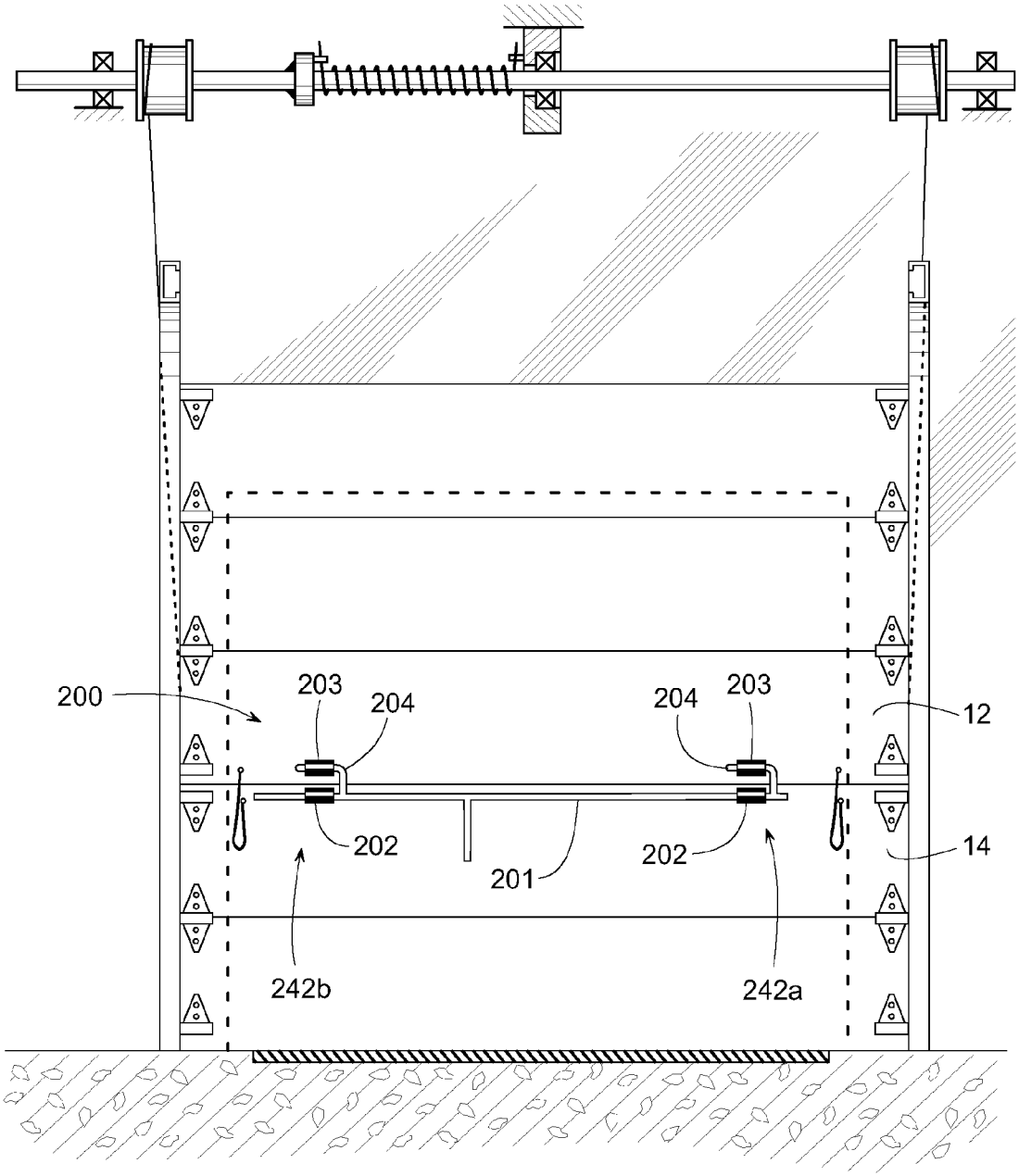
FIG. 16 is a front view of door with a latch mechanism, wherein the latch mechanism is engaged.
Figure 17:
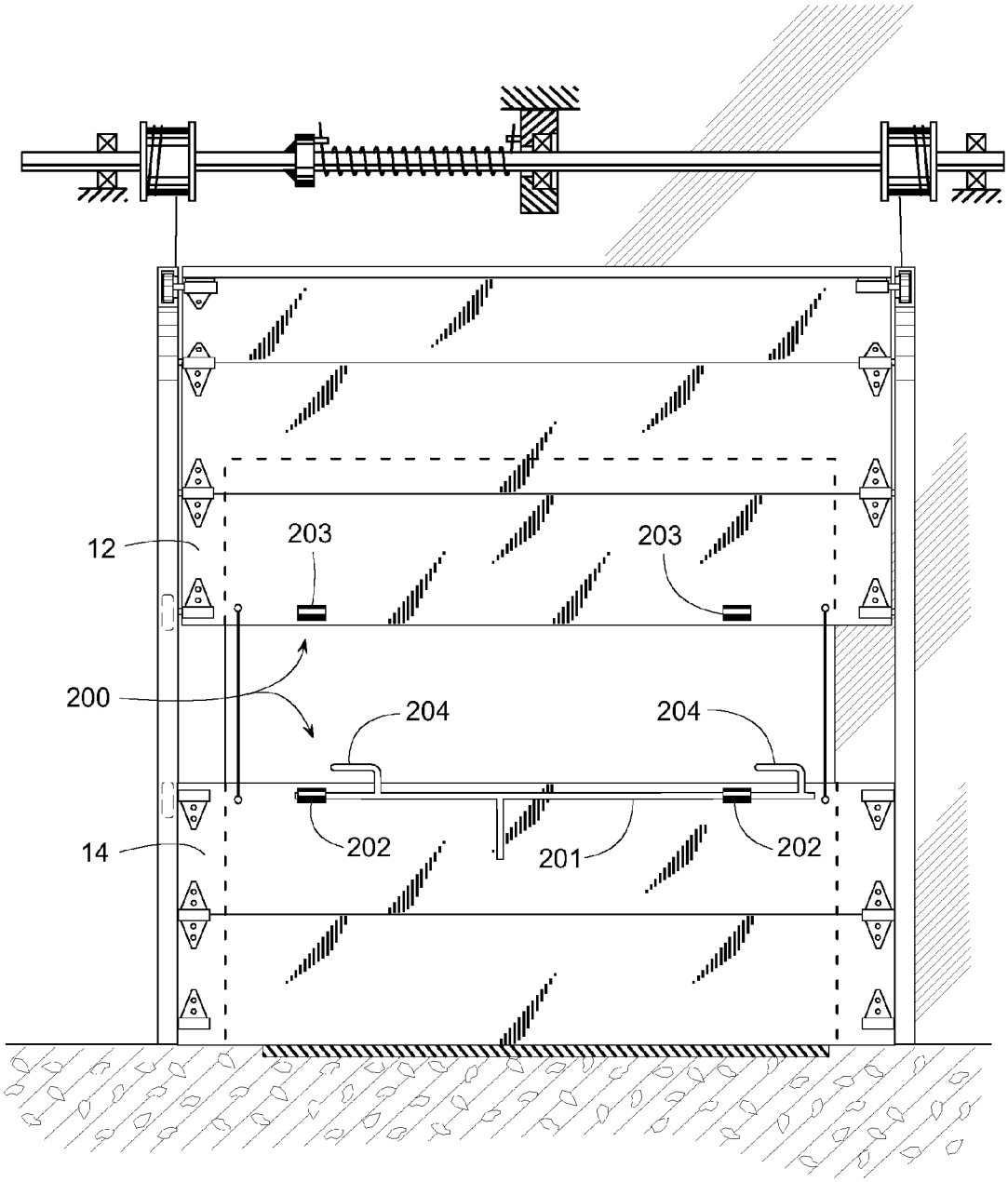
FIG. 17 is a front view similar to FIG. 17 but showing the latch mechanism disengaged.

FIGS. 16 and 17 illustrate a latch mechanism 200 where a right latch 242*a* and a left latch 242*b* can be actuated simultaneously by selectively moving (manually or otherwise) a connecting member 201 to the right or to the left. Connecting member 201 can slide horizontally within two lower tubes 202 that are attached to the door's lower section 14. A similar set of tubes 203 attached to the door's upper section 12 can each receive an L-shaped rod 204 that extends from member 201.

To connect the door's upper section 12 to its lower section 14, as shown in FIG. 16, sections 12 and 14 are brought together, and member 201 is moved to the left so that each rod 204 slides into its respective tube 203. Relative rotation of rod 204 within tube 203 provides a pivotal connection between door sections 12 and 14 so that the door has the flexibility to follow the path of a curved set of tracks as the door opens and closes. To separate sections 12 and 14, as shown in FIG. 17, member 201 is slid to the right to disengage each rod 204 from its corresponding tube 203.

Figure 18:
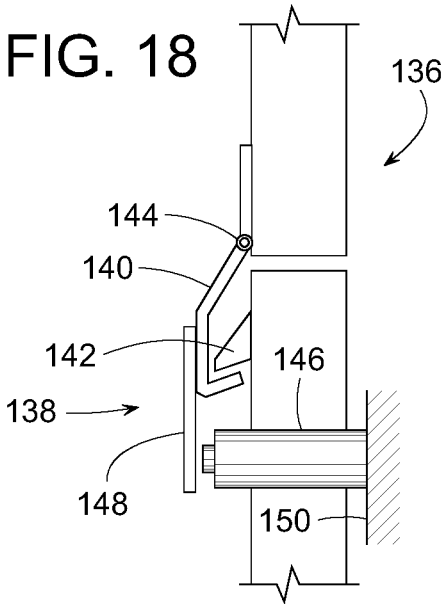
FIG. 18 is an end view showing solenoid-actuated latch in a latched state.
Figure 19:
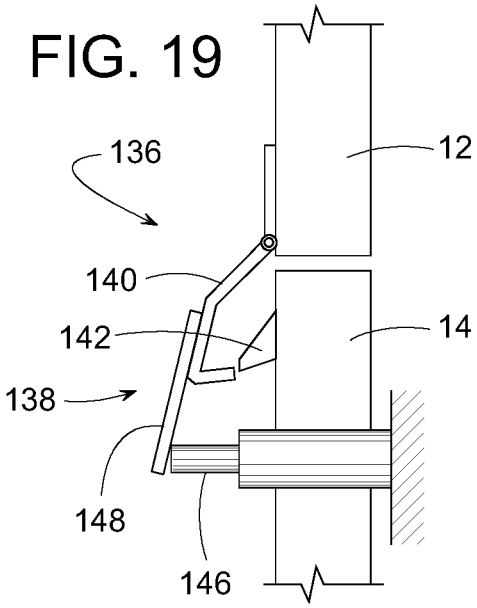
FIG. 19 is an end view similar to FIG. 18 but showing the latch in an unlatched state.
Figure 20:
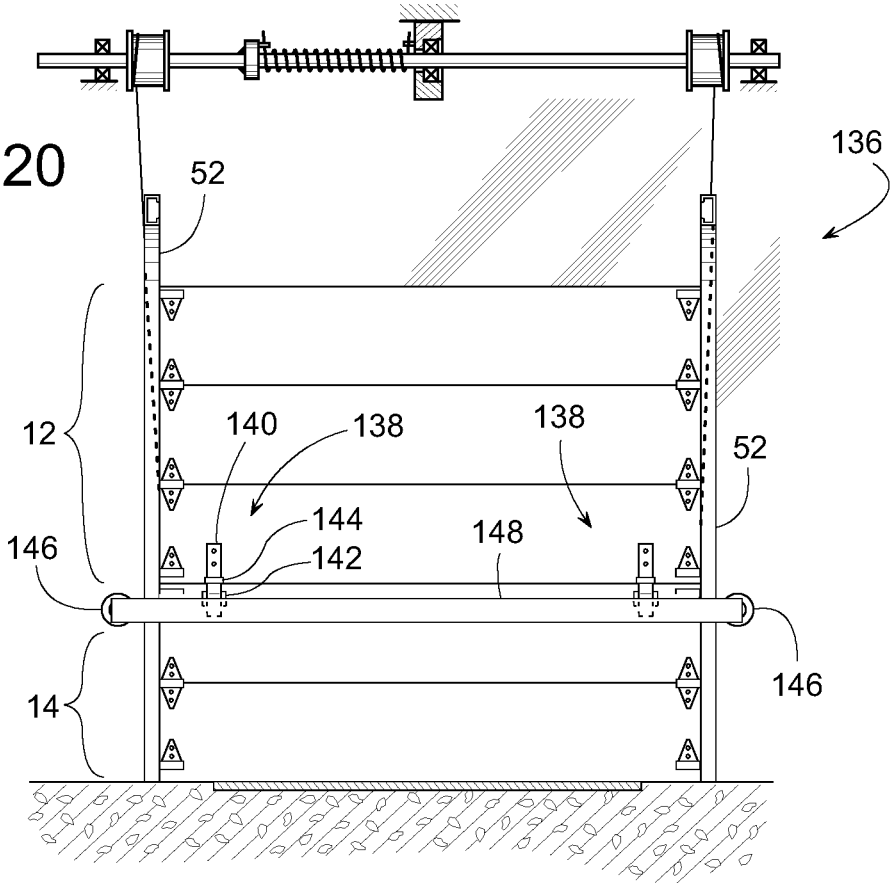
FIG. 20 is a front view of the door of FIG. 18.

Additional embodiments will now be described with reference to FIGS. 18-34. FIGS. 18-20 show a door 136 where upper and lower sections 12 and 14 can be selectively engaged and disengaged by an electrically actuated latch assembly 138. Latch assembly 138 includes a first member 140 attached to upper section 12 and a second member 142 attached to lower section 14. A hinge 144 pivotally enables first member 140 to latch onto a second member 142 that is attached to lower section 14. An electromechanical actuator 146, such as a solenoid, acts upon a connecting bar 148 to move latch assembly 138 between a latched state (FIG. 18) and an unlatched state (FIG. 19).

Connecting bar 148 may advantageously reach beyond the width of the door so that actuator 146 can be installed at a generally fixed location, such as against the wall or track 52. This allows selective energizing of actuator 146 without having to run extra electrical wiring to the moving part of the door. Bar 148 can be connected to two or more latch assemblies, as shown, so that multiple latch assemblies can be actuated simultaneously. Bar 148 or a similar connecting member (e.g., linkage, cable, chain, etc.) can also be applied to various other latch systems including, but not limited to those shown in FIGS. 1-9 and 11. It will be appreciated by those skilled in the art that actuator 146 may be mounted on the door and controlled via a wire (e.g., a coil cord) run to the door or via a wireless control.

Door 10 may also include a holding device 65 that helps hold lower section 14 down when door 10 is at its closed or barrier position. Holding device 65 is similar to latch 42' in that device 65 also comprises a spring-loaded arm 66 that selectively engages a catch member 68, wherein a tapered cam surface is disposed on arm 66 and/or member 68 to enable their automatic engagement with each other.

Figure 21:
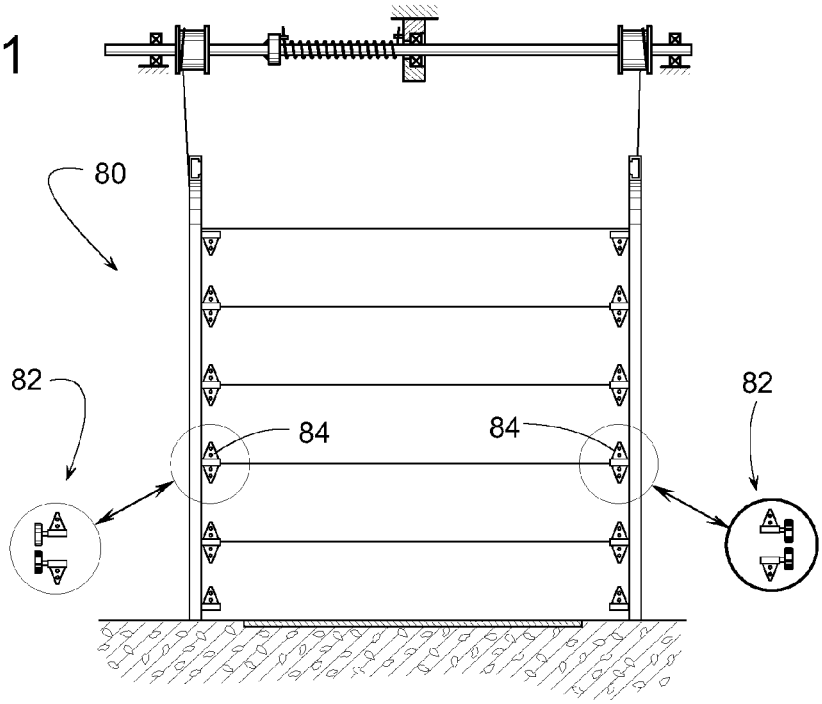
FIG. 21 is a front view showing how an existing door can be retrofitted.
Figure 22:
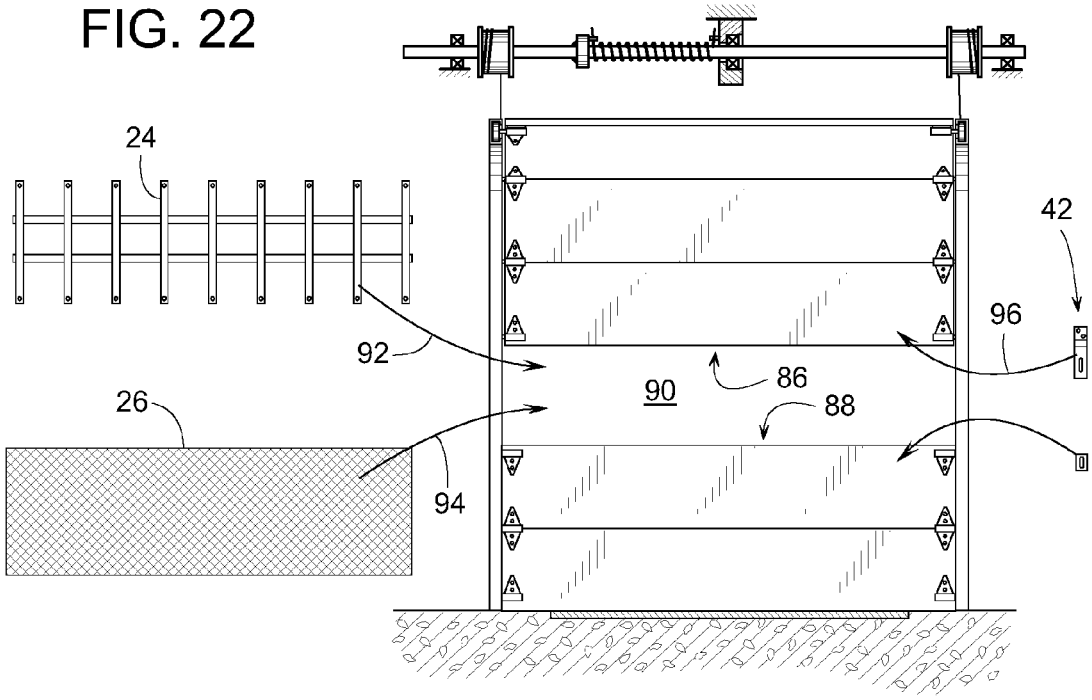
FIG. 22 is a front view showing how an existing door can be retrofitted.

The doors of FIGS. 1-11 can be made as new doors, or they can be the result of retrofitting an existing door 80, as illustrated in FIGS. 21 and 22. A pair of separate roller elements 82, for instance, can replace two conventional roller hinges 84 to create an upper section 86 and a lower section 88. The two sections 86 and 88 can then be disengaged and separated to create a ventilation area 90, the lattice of straps 24 or mesh 26 can be installed between sections 86 and 88, and latch 42 can be attached to the door. The step of installing a plurality of straps is represented by arrow 92, the step of installing a mesh is represented by arrow 94, and the steps of installing a latch and providing for reconnection of sections 12 and 14 are represented by an arrow 96.

Figure 23:
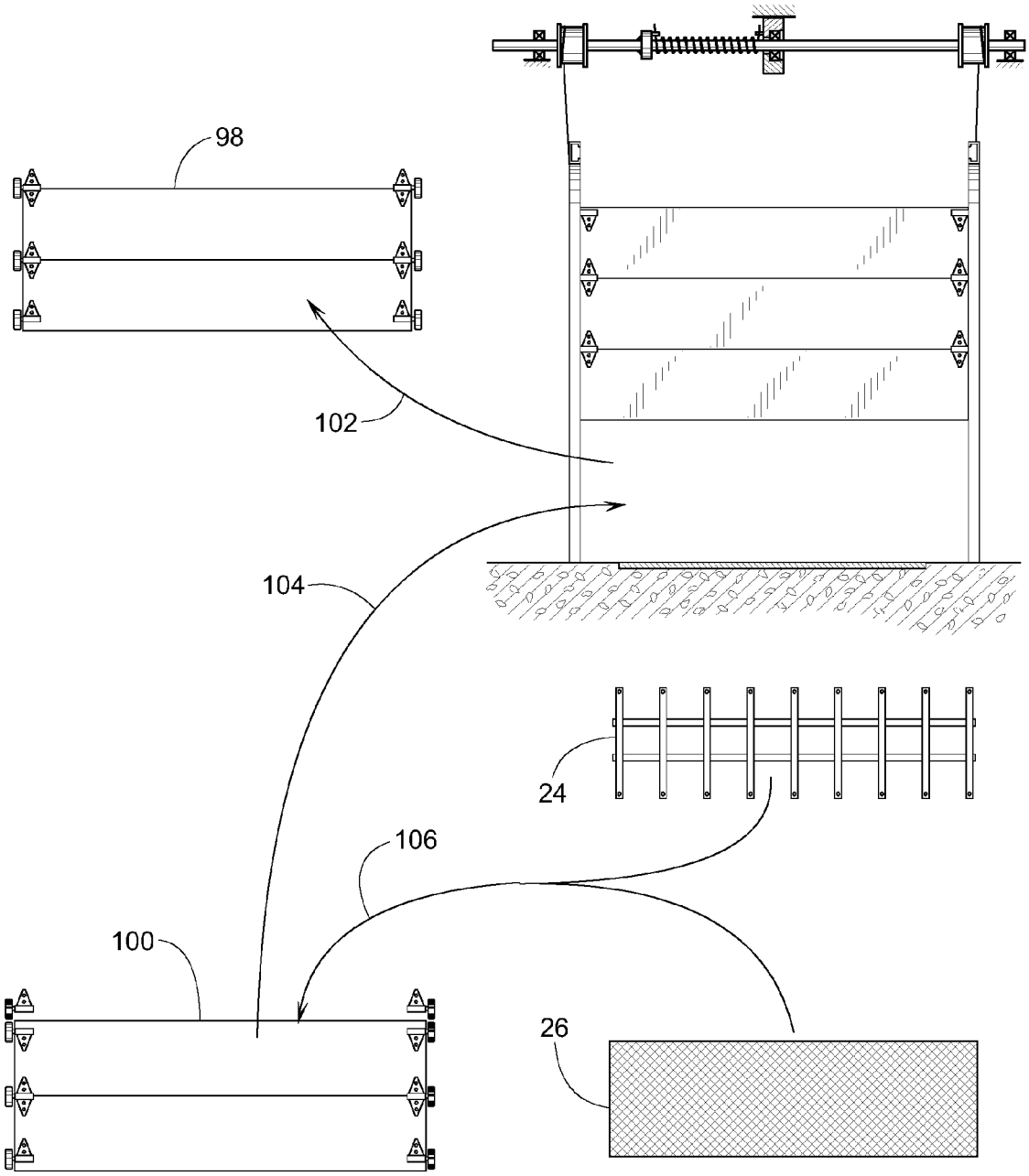
FIG. 23 is a front view showing how an existing door can be retrofitted.

FIG. 23 illustrates another method of retrofitting an existing door by replacing an existing lower section 98 with a new lower section 100, as represented by arrows 102 and 104. In this example, an arrow 106 represents the step of installing straps 24 or installing mesh 26.

Referring to FIGS. 24-34, although a lower section 108 of a door 110 can serve as a safety barrier for runoff protection, a separate, but door-integrated barrier 112 can be installed to help protect lower section 108. Such a barrier is preferably lightweight to ease the opening of the door and should be shock absorbing to minimize the force of an impact. Because the resilient barrier 112 keeps lower section 108 of a door 110 from being impacted, lower section 108, and door 110 in general, can be constructed of lighter, less expensive material. Further, a separate barrier 112 provides the user with the ability to detach it from lower section 108 of door 110 to leave barrier 112 in place while raising the entire door 110. Thus, barrier 112 acts to protect lower section 108, but more importantly, it acts to prevent the runoff of a fork truck and other dock traffic without barrier 112 itself becoming permanently deformed.

Figure 24:
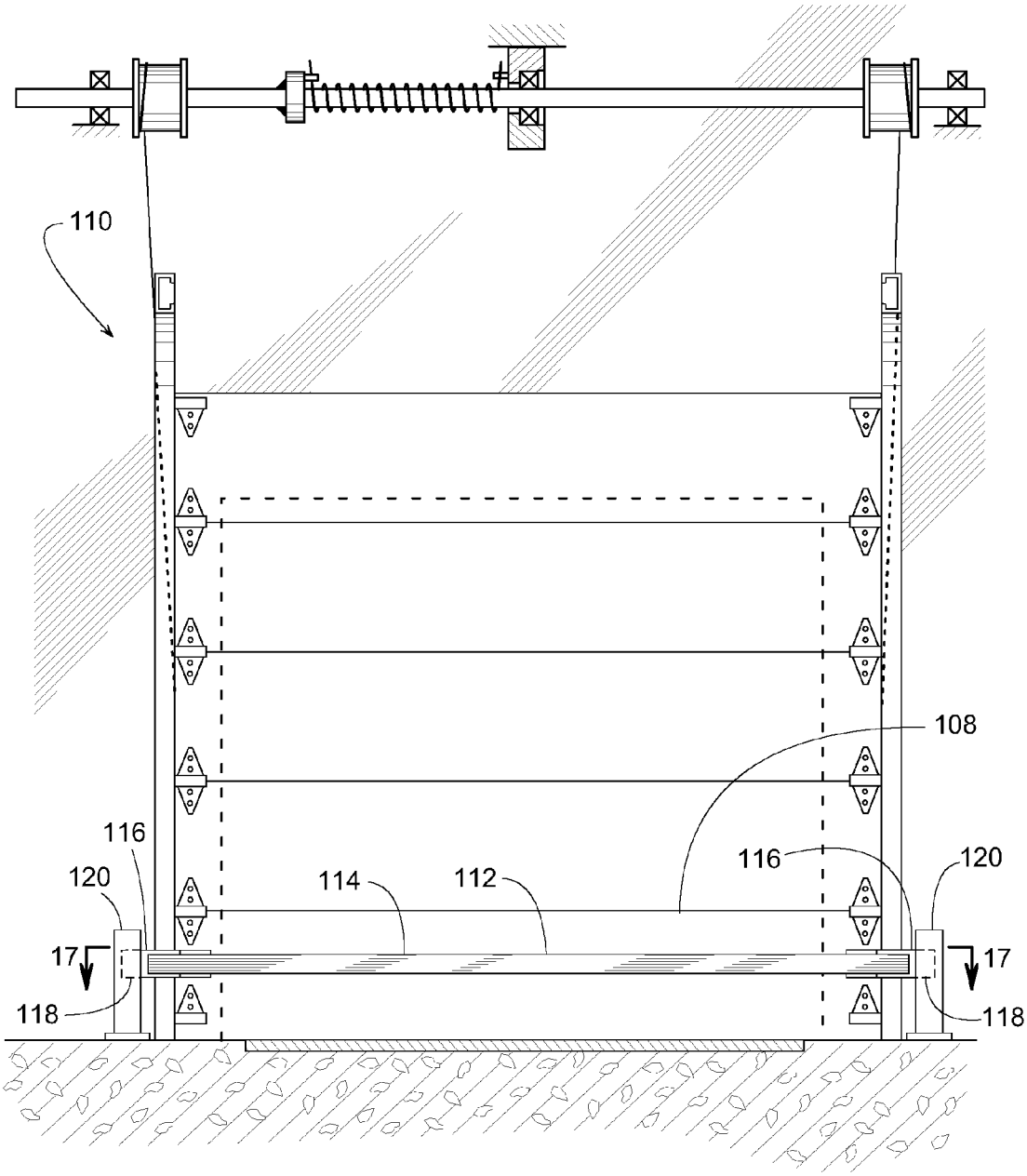
FIG. 24 is a front view of a closed door with a lightweight, resilient barrier.
Figure 25:
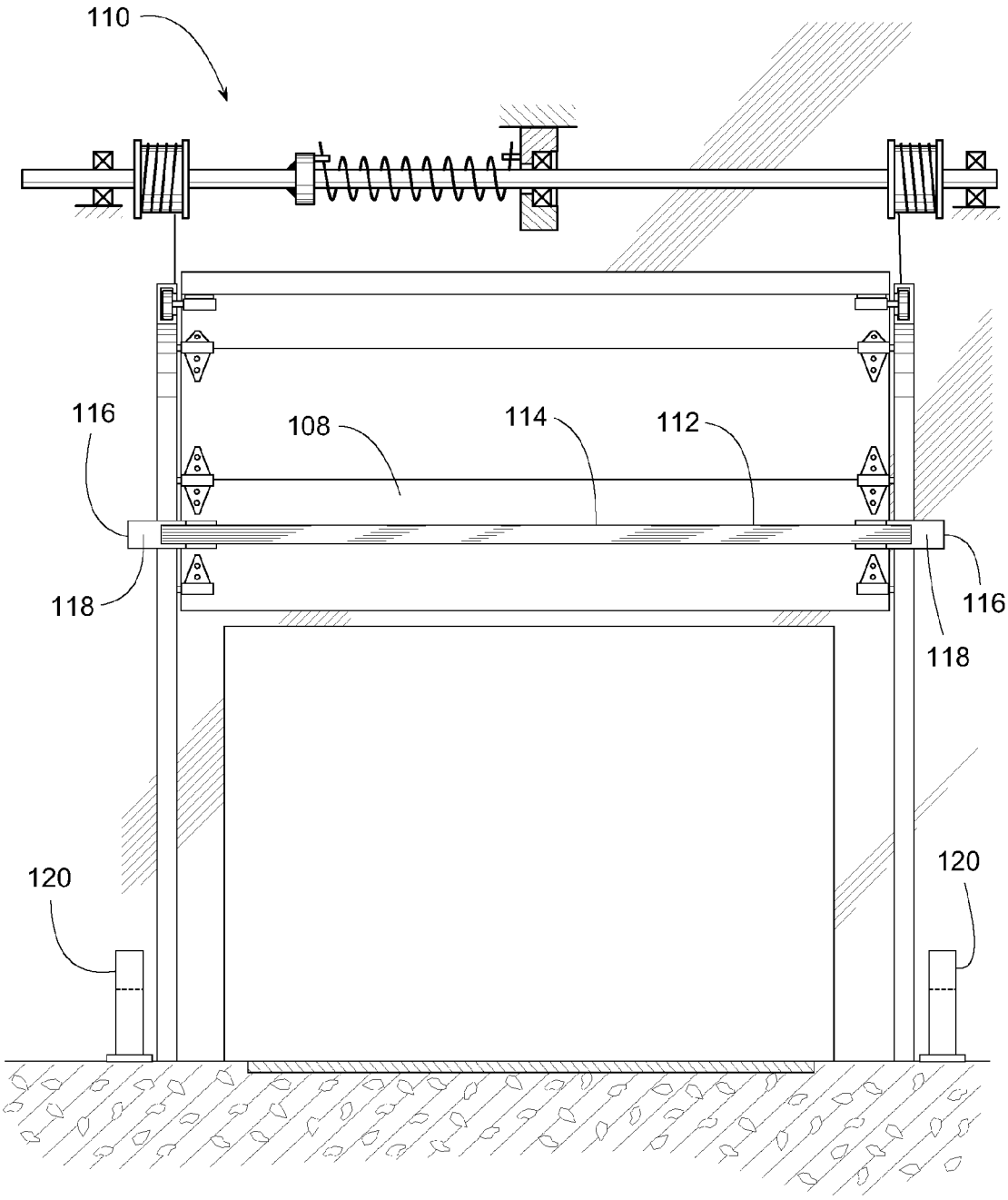
FIG. 25 is a front view similar to FIG. 24 but showing the door open.

To this end, some embodiments of barrier 112 comprise a resilient member 114, such as a nylon strap, bar, cable, chain, etc., that may optionally be held in tension between two opposite ends 116, which in turn are attached to lower section 108. Because barrier 112 is intended to stop a fork truck, an interaction that causes significant (but non-permanent) deformation of resilient member 114, resilient member 114 must be spaced apart from lower section 108 to allow resilient member 114 to yield from the impact, but ultimately stop the fork truck before its wheels reach the end of the leveler or other drop-off point. To reduce forces of impact against lower section 108, each end 116 may comprise a metal bracket 118 that can engage a stationary abutment 120 when door 110 is closed (FIG. 24). The engagement between brackets 118 and abutment 120 can occur automatically by simply closing the door, or the engagement may be the result of an impact forcing bracket 118 into abutment 120. Regardless, brackets 118 can transmit a significant portion of an impact force 122 (FIG. 27), such as from a carelessly driven forklift truck 124, into abutments 120 rather than delivering the entirety of force 122 into lower section 108. When door 110 opens (FIG. 25), brackets 118 lift away from abutments 120. In some cases, brackets 118 lift out from within a slot 126 in abutment 120.

Figure 29:
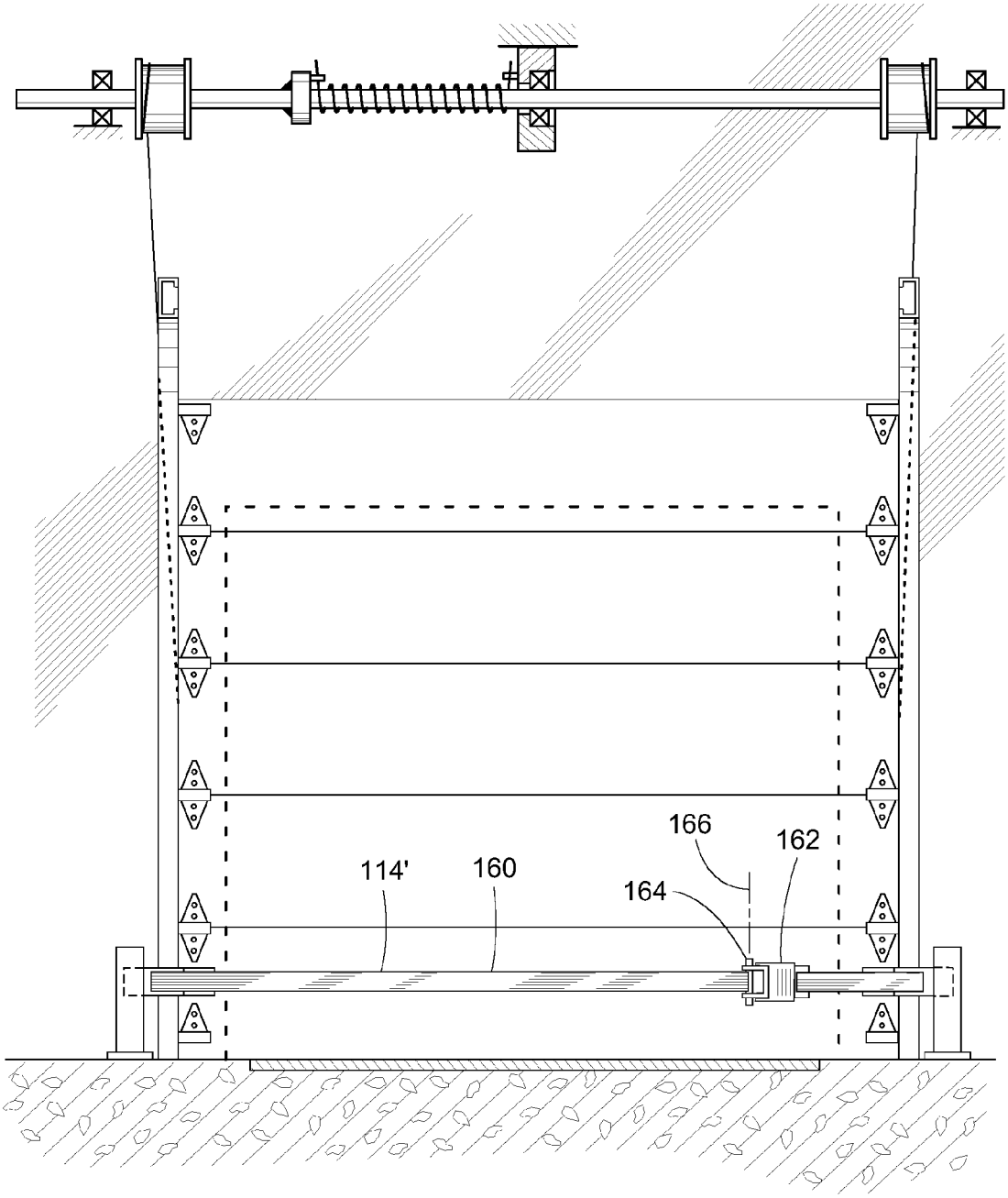
FIG. 29 is a front view similar to FIG. 24 but with a tensioning device added to the strap.

FIG. 29 shows an enhancement of the embodiment shown in FIGS. 24-27. A barrier 160 includes a resilient member 114', such as a strap, which can be tightened by a conventional strap-tightening ratchet device 162. One end of member 114' wraps around a shaft 164 that can be rotated about its longitudinal centerline 166 for tightening member 114'. To prevent creep from reducing the tension in member 114' and diminishing the barrier's effectiveness, ratchet device 162 can periodically retighten and/or reduce the slack in member 114'.

Figure 30:
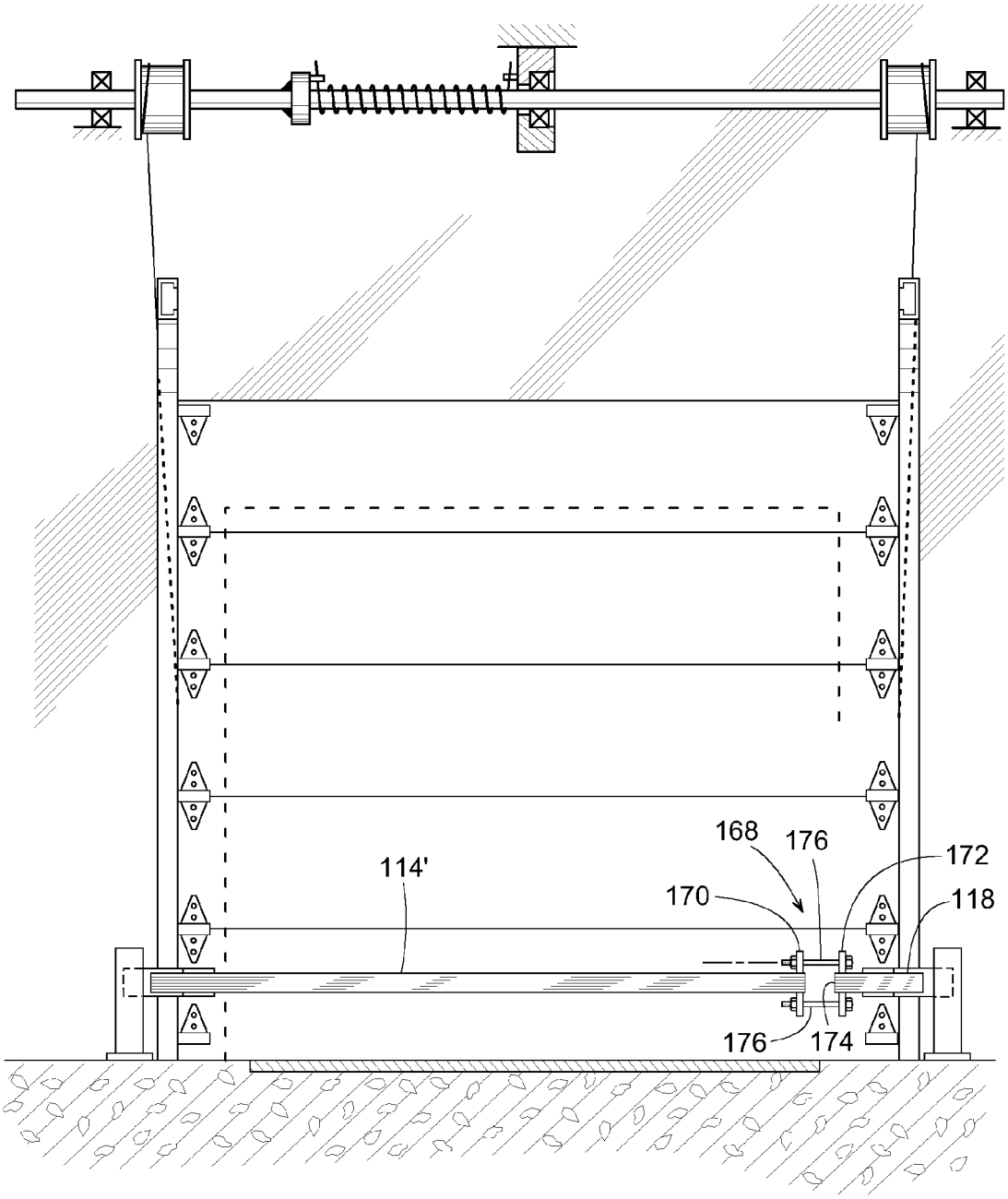
FIG. 30 is a front view similar to FIG. 29 but showing an alternate tensioning device.

In a similar embodiment, shown in FIG. 30, a different tightening device 168 replaces ratchet device 162. Tightening device 168 may comprise two bars 170 and 172 with one bar 170 being coupled to resilient member 114' and the other bar 172 either being connected to a second resilient member 174 or incorporated with bracket 118. One or more threaded shafts 176 (e.g., threaded rod, bolt, screw, etc.) can be tightened by relative rotation between shaft 176 and a mating threaded hole (e.g., a threaded nut or a tapped hole in bar 170). Tightening shafts 176 draw bars 170 and 172 toward each other, which increases the tension in resilient member 114'.

Figure 31:
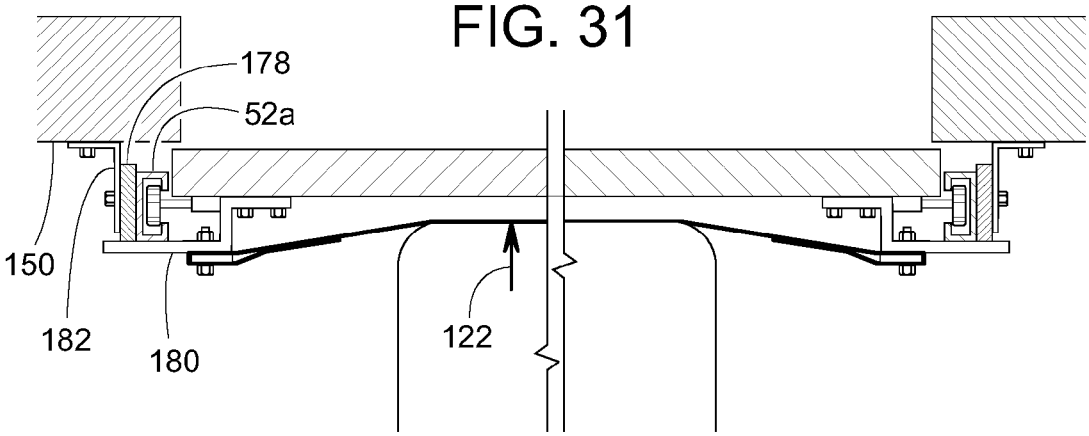
FIG. 31 is a cross-sectional top view similar to FIG. 27 but with the abutment of FIG. 27 replaced by a reinforced section of track.
Figure 32:
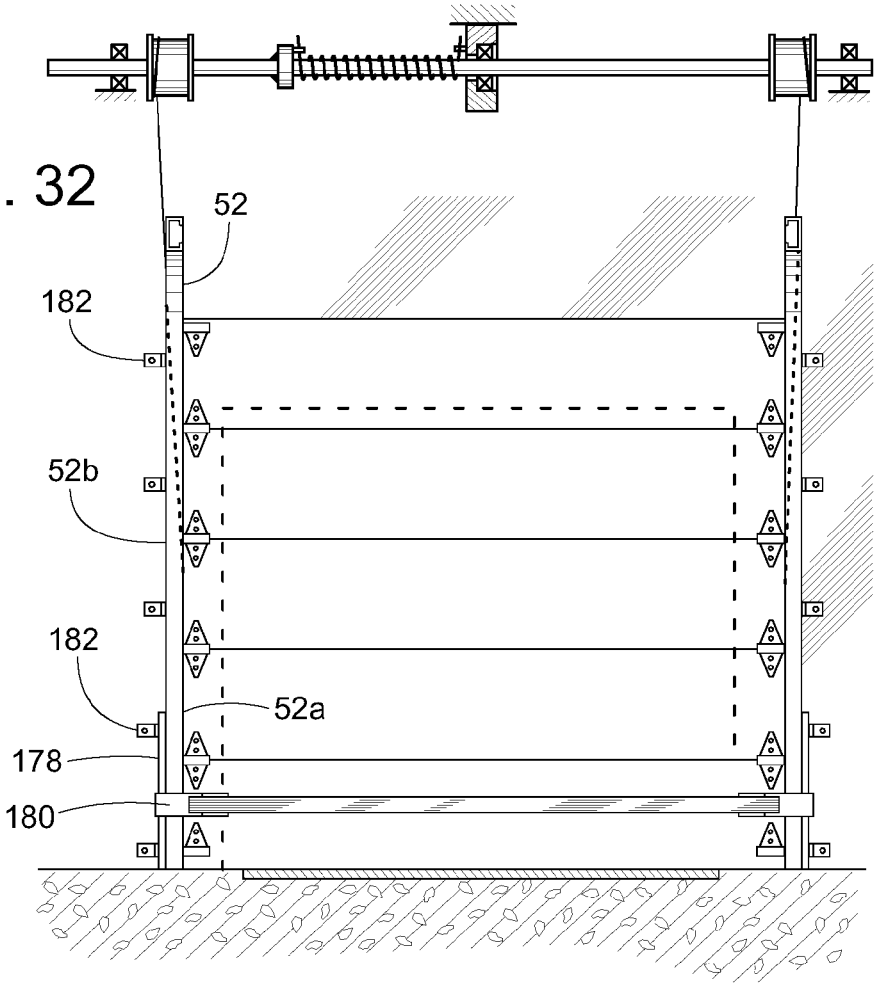
FIG. 32 is a front view of the door of FIG. 31.

The embodiment of FIGS. 31 and 32, is similar to that of FIGS. 24-27; however, abutment 120 is replaced by a lower track section 52*a* that is reinforced by a bar 178. Bracket 180 transmits a force of impact 122 into the reinforced lower track section 52*a*, which now serves as an abutment. To minimize the total cost of track 52, an upper track section 52*b* does not necessarily have to be reinforced. Brackets 182 connect track 52 to wall 150.

Figure 26:
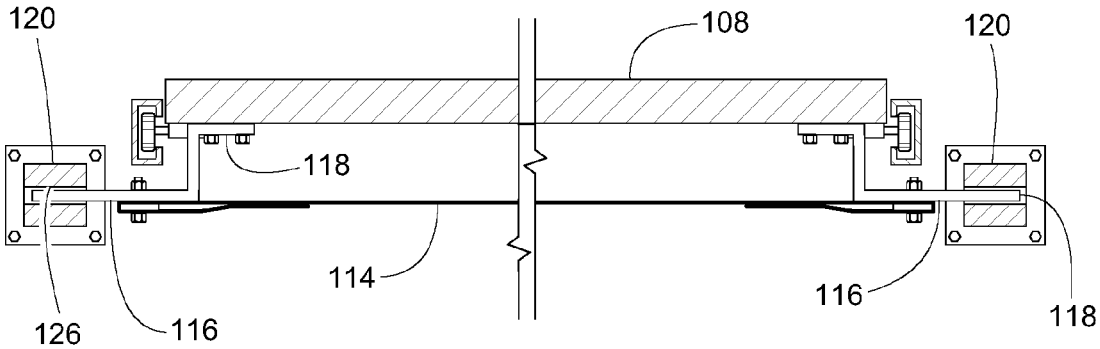
FIG. 26 is a cross-sectional view taken along line 26-26 of FIG. 24.
Figure 27:
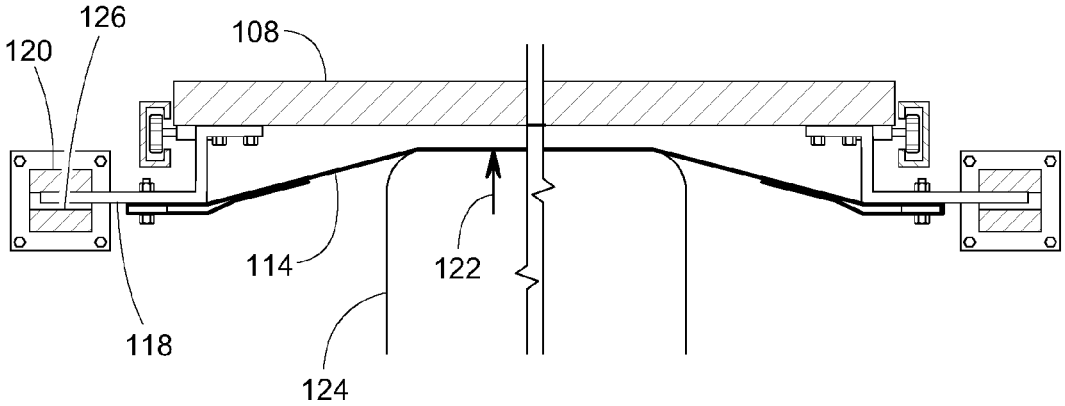
FIG. 27 is a cross-sectional view similar to FIG. 26 but showing the results of the barrier being subjected to a force of impact.
Figure 33:
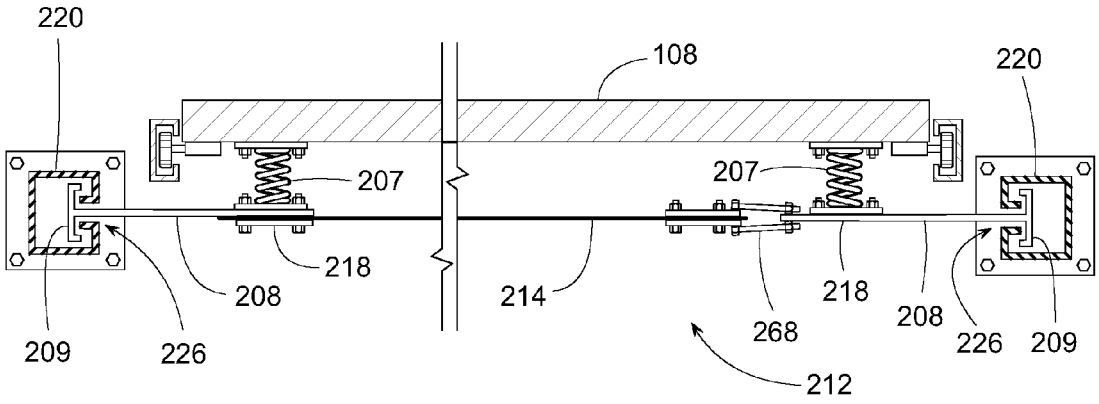
FIG. 33 is a top cross-sectional view similar to FIG. 26 but of another embodiment.
Figure 34:
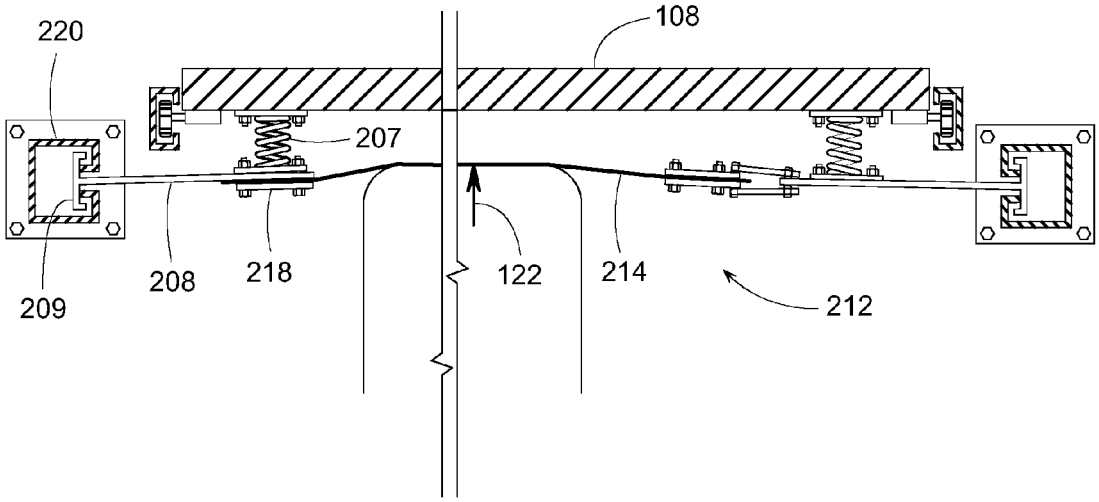
FIG. 34 is a top cross-sectional view similar to FIG. 27 but showing the embodiment of FIG. 33.

Another embodiment similar to that of FIGS. 24-32 is shown in FIGS. 33 and 34, which correspond to FIGS. 26 and 27, respectively. In this example, a barrier 212 comprises a resilient member 214 held between two brackets 218. A tightening device 268, similar to device 168 of FIG. 30 can adjust the tension in resilient member 214. Each bracket 218 includes an impactable spring 207 for mounting bracket 218 to door panel 108. The resilience of spring 207 helps prevent bracket 218 from being permanently deformed under impact. Bracket 218 also includes a tab 208 that can slip down into a slot 226 of a stationary abutment 220 for transferring impact force 122 into the abutment. Operating the door can move tab 208 in and out of slot 226 in a manner similar to that of bracket 118 and slot 126 of FIG. 26. Tab 208 may include a flange 209 that helps prevent the impact from pulling tab 208 horizontally out from within slot 226. It is desirable to avoid the permanent deformation of bracket 218, because such permanent deformation may prevent tab 208 from properly aligning with slot 226 resulting in a malfunction of the barrier 212.

Figure 28:
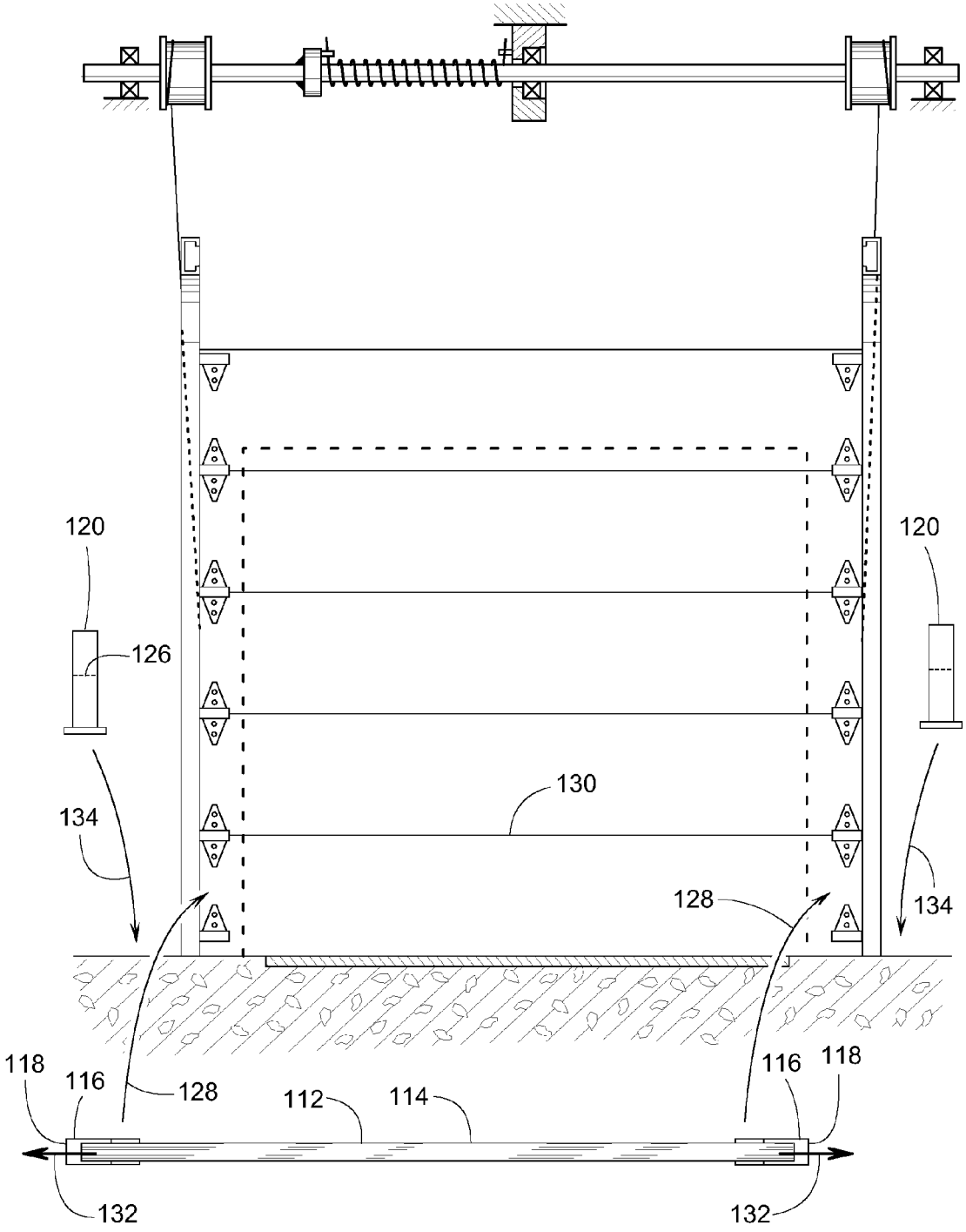
FIG. 28 is a front view showing how a door can be retrofitted with a barrier.

Door 110 can be made as a new door, or it can be the result of retrofitting an existing door, as illustrated in FIG. 28. Arrows 128 represent the step of installing barrier 112 by attaching ends 116 to a door panel 130, arrows 132 represents pulling resilient member 114 in tension, and arrows 134 represent mounting two abutments adjacent an existing door.

Although the invention is described with reference to preferred embodiments, it should be appreciated by those of ordinary skill in the art that various modifications are well within the scope of the invention.

What is claimed is:

1. A door to be selectively movable to a closed position, a barrier position, and an open position relative to a doorway of a wall, the door comprising:

an upper section to be vertically translatable relative to the doorway along a track via a first roller attached to the upper section;

a lower section to be disposed below the upper section and to be vertically translatable relative to the doorway along the track via a second roller attached to the lower section; and a selectively separable connection to be between the upper and lower sections to effect selectively, upon vertical translation of the upper section, one of the upper and lower sections being coupled together without separation or the upper and lower sections being uncoupled to enable separation therebetween at a predetermined location of the lower section, such that:

a) in the closed position, the upper section may abut the lower section at an elevation where the upper section and the lower section can substantially close off the doorway;

b) in the barrier position, the upper section is vertically spaced-apart from the lower section while retaining a connection to the lower section, to define a ventilation area therebetween, whereby the ventilation area enables air to pass through the doorway; and c) in the open position, the upper section and the lower section abut one another and are elevated to open up the doorway.

2. The door of claim 1, wherein the lower section being in a fully lowered position when the door is at the closed position, and the lower section being in the fully lowered position when the door is at the barrier position.

3. The door of claim 1, wherein the upper section is pivotally coupled to the lower section when the door is at the closed position and when the door is at the open position.

4. The door of claim 1, further comprising a mesh to be coupled to the upper section and the lower section such that the mesh extends across the ventilation area when the door is at the barrier position.

5. The door of claim 1, further comprising a counterbalance for counterbalancing the weight of the door as the door moves with the upper and lower sections connected, and a mechanism to compensate for the reduced weight of the door in the barrier position.

6. The door of claim 5, wherein the mechanism comprises a winch extending between the upper section and the lower section for controlling the relative movement of the upper section and the lower section.

7. The door of claim 5, wherein the mechanism comprises an elongate member connected to the upper section, wherein the elongate member exerts an upward force against the upper section when the door is at the barrier position, and a separation-limiting member extending between the upper section and the lower section, wherein the separation-limiting member is to exert a downward force against the upper section when the door is at the barrier position.

8. The door of claim 1, further comprising a latch that enables the upper section to be latched to the lower section.

9. The door of claim 8, wherein the latch automatically latches the upper section to the lower section in response to the upper section and the lower section coming together.

10. The door of claim 8, further comprising an actuator that moves the latch between a latched position and an unlatched position.

11. The door of claim 1, further comprising a holding device to at least partially enable the lower section to be held down when the door is at the barrier position.

12. The door of claim 5, wherein the mechanism comprises a deadweight that is movable to be selectively carried by and separated from the upper section.

13. The door of claim 1, wherein the lower section is stronger and more resilient than the upper section so that the lower section can provide an impact-resistant barrier when the door is in the barrier position.

14. The door of claim 1, wherein the track includes an upper track section and a lower track section, and the lower track section is reinforced to render the lower track section more impact resistant than the upper track section.

15. A method of modifying an existing door that includes an existing upper section coupled to an existing lower section that are vertically movable between a closed position and an open position, the method comprising:

replacing the existing lower section with a retrofit lower section, the retrofit lower section having a roller positioned within a track to guide the door;

selectively coupling, without separation, the retrofit lower section to the existing upper section when in either of the closed position or the open position via a separable joint, the upper section having a second roller positioned within the track; and selectively separating the retrofit lower section from the existing upper section via the separable joint while maintaining a connection between the retrofit lower section and the upper section to create a ventilation area therebetween.

16. The method of claim 15, further comprising installing a latch between the upper section and the lower section such that the latch enables the upper section to selectively abut and separate from the lower section.

17. The method of claim 15, further comprising installing a mesh between the upper section and the lower section.

18. The method of claim 15, further comprising installing a plurality of straps between the upper section and the lower section.

19. A method of modifying a vertically movable door that includes an upper section coupled to a lower section, the upper and lower sections being vertically movable between a closed position and an open position, the method comprising:

decoupling the upper section and the lower section;

coupling a plurality of first roller elements to the upper section;

coupling a plurality of second roller elements to the lower section, wherein the first roller elements are separate from the second roller elements, and where the first roller elements and the second roller elements run along a track;

coupling the lower section to the upper section; and selectively separating the lower section from the upper section while maintaining a connection between the sections, to create a ventilation area therebetween, wherein the upper and lower sections move in unison when being vertically moved between the closed position and the open position.

20. The door of claim 1, wherein a distance between the vertically spaced-apart upper and lower sections in the barrier position is at least as wide as a width of one of the sections measured in a direction parallel to translation of the door.

* * * * *